US008608958B2

(12) United States Patent
Oda

(10) Patent No.: US 8,608,958 B2
(45) **Date of Patent: *Dec. 17, 2013**

(54) FLOWING WATER SPLITTING APPARATUS, FLOWING WATER SPLITTING METHOD AND SEWAGE SYSTEM

(76) Inventor: Shuhei Oda, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/603,774

(22) Filed: Sep. 5, 2012

(65) Prior Publication Data

US 2012/0325346 A1 Dec. 27, 2012

Related U.S. Application Data

(63) Continuation of application No. 12/457,678, filed on Jun. 18, 2009, now Pat. No. 8,343,340, which is a continuation of application No. PCT/JP2008/073611, filed on Dec. 25, 2008.

(30) Foreign Application Priority Data

Jun. 25, 2008 (JP) ..... 2008-165371

(51) Int. Cl.
*E03F 5/14* (2006.01)

(52) U.S. Cl.
USPC ..... 210/170.03

(58) Field of Classification Search
USPC ..... 210/162, 170.03, 747.1, 747.2, 170.01
See application file for complete search history.

(56) References Cited

U.S. PATENT DOCUMENTS 5,770,057 A 6/1998 Filion
8,343,340 B2 * 1/2013 Oda ..... 210/170.03
2004/0222159 A1 * 11/2004 Peters et al. ..... 210/688
2006/0054562 A1 3/2006 Peters, Jr. et al.
2008/0023074 A1 * 1/2008 Uemura et al. ..... 137/237

FOREIGN PATENT DOCUMENTS

JP 2004-027701 A 1/2004
JP 4168087 B1 8/2008
WO 2006/013634 A1 2/2006

OTHER PUBLICATIONS

Japan Sewage Works Association, "Planning Sewage facility: Guideline for design and commentary" Dec. 2001, p. 262.
Japan Sewage Works Association, "Improvement of combined sewer: Guideline and commentary" Jun. 2002,p. 153.
Japan Institute of Wastewater Engineering Technology, "Manual of operation and maintenance facility technology for rainwater reservoir facilities for sewage system", Jun. 30, 1996, pp. 11-12.

* cited by examiner

*Primary Examiner* — Sunil Singh
(74) *Attorney, Agent, or Firm* — Kubotera & Associates, LLC

(57) ABSTRACT

A flowing water splitting apparatus includes a first flowing water channel including a weir defining a water quantity of the flowing water flowing in from a confluent pipe and leading the flowing water flowing in from the confluent pipe to a dirty water pipe; a second flowing water channel leading flowing water flowing over the weir to a rainwater pipe; a partition wall portion provided to block the flowing water flowing through the first flowing water channel to form a plurality of water diversion chambers partitioned in the first flowing water channel; and a flow throttle portion formed in the partition wall portion to throttle a flow quantity of the flowing water flowing from one water diversion chamber into another water diversion chamber.

11 Claims, 29 Drawing Sheets

FLOWING WATER SPLITTING APPARATUS, FLOWING WATER SPLITTING METHOD AND SEWAGE SYSTEM

CROSS-REFERENCE TO RELATED APPLICATIONS

This is a continuation application of U.S. patent application Ser. No. 12/457,678, filed on Jun. 18, 2009, now U.S. Pat. No. 8,343,340, which is a continuation application of the prior PCT application PCT/JP2008/073611, filed on Dec. 25, 2008, which claims the priority of Japanese patent application No. 2008-165371, filed on Jun. 25, 2008.

FIELD OF THE INVENTION AND RELATED ART STATEMENT

The present invention relates to a flowing water splitting apparatus, a flowing water splitting method, and a sewage system each splitting flowing water and, in particular to a flowing water splitting apparatus, a flowing water splitting method, and a sewage system each splitting sewage in which rainwater and dirty water are mixed into rainwater and dirty water.

As shown in FIG. 22 to FIG. 29, to a conventional rainwater discharge chamber 100, a rainwater discharge chamber main body 102, a confluent sewage line inflow pipe (referred to as a "confluent pipe" when necessary) 104, a dirty water pipe 106, and a rainwater pipe 108 are connected. Here, sewage (dirty water (domestic waste water)+rainwater) flows into the confluent pipe 104, the dirty water pipe 106 leads to a sewage treatment apparatus, and the rainwater pipe 108 leads to a public water area such as a river or the like.

Inside the rainwater discharge chamber main body 102, a first flowing water channel 110 is formed through which the sewage flowing in from the confluent pipe 104. The first flowing water channel 110 is provided to connect the confluent pipe 104 and the dirty water pipe 106, and a weir 112 having a predetermined height is formed on one side thereof in the width direction. Therefore, the sewage flowing in from the confluent pipe 104 will flow through the first flowing water channel 110 surrounded on both sides by an inner wall of the rainwater discharge chamber main body 102 and the weir 112 to the dirty water pipe 106 side. Further, when the water quantity of the sewage flowing in from the confluent pipe 104 is equal to or less than a predetermined quantity, the sewage never flows over the weir 112 but all the water quantity of the sewage flowing in from the confluent pipe 104 flows into the dirty water pipe 106 through the first flowing water channel 110 and is conveyed to the sewage treatment apparatus.

Further, inside the rainwater discharge chamber main body 102 and below the first flowing water channel 110, a second flowing water channel 114 is formed through which the sewage flowing over the weir 112 of the first flowing water channel 110 flows. The second flowing water channel 114 is connected to a rainwater pipe 108, so that the sewage flowing over the weir 112 of the first flowing water channel 110 flows through the second flowing water channel 114 and then flows into the rainwater pipe 108 to be conveyed to a public water area such as a river or the like.

As described above, according to the conventional rainwater discharge chamber 100, when the water quantity of the sewage flowing from the confluent pipe 104 into the rainwater discharge chamber main body 102 is equal to or less than a predetermined quantity as shown in FIG. 22 to FIG. 25, the sewage flowing into the rainwater discharge chamber main body 102 never flows over the weir 112 but flows through the first flowing water channel 110 as it is to enter the dirty water pipe 106. Then, the sewage in the dirty water pipe 106 is conveyed to the sewage treatment apparatus.

On the other hand, when the water quantity of the sewage flowing from the confluent pipe 104 into the rainwater discharge chamber main body 102 is greater than the predetermined quantity as shown in FIG. 26 to FIG. 29, the sewage flowing into the rainwater discharge chamber main body 102 flows through the first flowing water channel 110 and a part of it flows over the weir 112 to flow through the second flowing water channel 114. Therefore, the sewage flowing through the first flowing water channel 110 to enter the dirty water pipe 106 flows into the sewage treatment apparatus, and the sewage flowing through the second flowing water channel 114 to enter the rainwater pipe 108 flows into the public water area such as a river or the like.

Patent Document 1: Japanese Patent Application Laid-open No. 2004-27701

However, in the prior art, because of a low function of splitting the sewage flowing from the confluent pipe into the rainwater discharge chamber to the dirty water pipe and the rainwater pipe, a greater water quantity of the sewage flows into the dirty water pipe so that the treatment load on the sewage treatment apparatus tends to increase. In particular, the dimension of the internal structure of the rainwater discharge chamber, the water quantity of the sewage flowing in from the confluent pipe, the water quantity of the sewage drained from the dirty water pipe and so on are designed in advance to take predetermined values, but the water quantity of the sewage flowing into the dirty water pipe becomes greater than expected, resulting in a limit in the treatment function of the conventional sewage treatment apparatus. Therefore, the sewage treatment apparatus tends to be enhanced in function and increased in size in order to enhance the treatment function of the sewage treatment apparatus, thus bringing about a problem of an accordingly significant increase in facility cost of the sewage treatment apparatus.

Hence, in consideration of the above circumstances, an object of the present invention is to provide a flowing water splitting apparatus, a flowing water splitting method, and a sewage system each capable of enhancing the flow quantity splitting function for the sewage (flowing water) by a simple structure to reduce the flow quantity of the sewage (flowing water) flowing to a dirty water pipe.

SUMMARY OF THE INVENTION

A first invention is a flowing water splitting apparatus splitting flowing water flowing in from a confluent pipe and conveying the water to a dirty water pipe and a rainwater pipe, the apparatus including a first flowing water channel including a weir defining a water quantity of the flowing water flowing in from the confluent pipe and leading the flowing water flowing in from the confluent pipe to the dirty water pipe; a second flowing water channel leading flowing water flowing over the weir to the rainwater pipe; a partition wall portion provided to block the flowing water flowing through the first flowing water channel to form a plurality of water diversion chambers partitioned in the first flowing water channel; and a flow throttle portion formed in the partition wall portion to throttle a flow quantity of the flowing water flowing from one of the water diversion chambers into another of the water diversion chambers.

According to the first invention, the flowing water flowing in from the confluent pipe flows through the first flowing water channel in which its flow path is blocked by the partition wall portion and its flow quantity is throttled by the flow throttle portion. Thus, the flowing water in a part of the flow quantity reaches the dirty water pipe and is conveyed to the sewage treatment apparatus. Further, flowing of the most of the flowing water into the dirty water pipe is suppressed by the flow throttle portion and it is thus stored in the water diversion chambers. Then, after the flowing water is increasingly stored in the water diversion chamber, the water level of the flowing water therein finally exceeds the weir so that the flowing water overflows. The overflowing flowing water flows through the second flowing water channel to reach the rainwater pipe and is conveyed to the public water area such as a river or the like.

As described above, the flowing water flowing from the confluent pipe into the first flowing water channel is apt to be stored in the water diversion chambers because the flow-down quantity of the flowing water further flowing down through the first flowing water channel is suppressed by the flow throttle portion. Then, the flowing water stored in the water diversion chamber flows through the second flowing water channel to be led to the rainwater pipe. Therefore, the most of the flowing water flowing from the confluent pipe into the first flowing water channel is led to the rainwater pipe, and a part of it is led to the dirty water pipe. Thus, the flowing water quantity of the flowing water conveyed from the dirty water pipe to the sewage treatment apparatus can be reduced to decrease the operation load or the treatment load on the sewage treatment apparatus. As a result of this, the splitting function for the flowing water can be enhanced by the flowing water splitting apparatus with a simple structure, resulting in avoidance of an increase in size of the sewage treatment apparatus and suppress an increase in the manufacturing cost and the running cost (facility cost). Further, it is possible to suppress an increase in size of the flowing water splitting apparatus to prevent an increase in the manufacturing cost and the running cost of the flowing water splitting apparatus.

A second invention is characterized, in the flowing water splitting apparatus of the first invention, in that a plurality of the partition wall portions are provided in a flow-down direction of the flowing water flowing through the first flowing water channel, and that the plural water diversion chambers are successively formed along the flow-down direction of the flowing water.

According to the second invention, a plurality of the partition wall portions are provided in the flow-down direction of the flowing water flowing through the first flowing water channel, so that at least three or more water diversion chambers are formed. Then, the three or more water diversion chambers are successively (serially) formed along the flow-down direction of the flowing water. Therefore, the flowing water flowing in from the confluent pipe passes through at least the three water diversion chambers and its flow quantity is throttled by at least two flow throttle portions until the flowing water flows through the first flowing water channel to reach the dirty water pipe. This reduces the water quantity of the flowing water flowing through the first flowing water channel as it is to reach the dirty water pipe, and increases the water quantity of the flowing water flowing over the weir and flowing through the second flowing water channel to the rainwater pipe. In other words, the flow quantity of the flowing water flowing to the rainwater pipe is much greater than the flow quantity of the flowing water flowing to the dirty water pipe. As described above, the flowing water splitting apparatus with a simple structure can be used to further enhance the splitting function of splitting the flowing water flowing to the rainwater pipe and the flowing water flowing to the dirty water pipe.

A third invention is characterized, in the flowing water splitting apparatus of the first invention or the second invention, in that the flow throttle portion is an orifice.

According to the third invention, the flow throttle portion is an orifice, so that the flow quantity of the flowing water can be throttled only by forming the orifice in the partition wall portion. This makes it unnecessary to separately provide a device for throttling the flow quantity of the flowing water and possible to suppress an increase in size of the flowing water splitting apparatus, leading to prevention of an increase in the manufacturing cost and the running cost of the flowing water splitting apparatus.

A fourth invention is characterized, in the flowing water splitting apparatus of the first invention or the second invention, in that an impurity removing device removing impurities contained in the flowing water flowing in from the confluent pipe is provided in an upstream side water diversion chamber located on a most upstream side in the flow-down direction of the plural water diversion chambers, and that the flowing water from which the impurities have been removed by the impurity removing device is led to the flow throttle portion.

According to the fourth invention, since an impurity removing device removing impurities contained in the flowing water flowing in from the confluent pipe is provided in an upstream side water diversion chamber located on the most upstream side in the flow-down direction of the plural water diversion chambers, the impurities can be removed from the flowing water in the upstream side water diversion chamber located on the most upstream side in the flow-down direction of the plural water diversion chambers. Then, the flowing water from which the impurities have been removed is led to the flow throttle portion of each of the partition wall portions, and flows toward the dirty water pipe while its flow quantity is being throttled. As described above, though the flowing water flowing in from the confluent pipe contains impurities, the impurities can be removed, so that the flowing water contains no impurities can be conveyed to the flow throttle portion and the dirty water pipe. As a result of this, it is possible to prevent the throttle portion from being clogged with the impurities to thereby maintain the flow throttle function of the flow throttle portion.

A fifth invention is characterized, in the flowing water splitting apparatus of the fourth invention, in that an adjusting weir constituting a part of the weir forming the upstream side water diversion chamber is provided at a position opposite the confluent pipe of the upstream side water diversion chamber, and that flowing water flowing over the adjusting weir is led to the second flowing water channel.

According to the fifth embodiment, an adjusting weir constituting a part of the weir forming the upstream side water diversion chamber is provided at a position opposite the confluent pipe of the upstream side water diversion chamber, and flowing water flowing over the adjusting weir is led to the second flowing water channel. Therefore, the adjusting weir is provided in the direction in which the flowing water flowing from the confluent pipe into the upstream side water diversion chamber in the first flowing water channel flows while maintaining its momentum. Thus, the force of flowing of the flowing water can be utilized to move the impurities contained in the flowing water to the adjusting weir side. Then, the impurities flow over the adjusting weir to fall down into the second flowing water channel, whereby the impurities can be easily led to the second flowing water channel side. As a result of this, the impurities can be easily removed from the flowing water without separately providing human or mechanical operation and management.

A sixth invention is characterized, in the flowing water splitting apparatus of the fifth invention, in that the impurity removing device is composed of a filtration screen including a plurality of screen bars provided at a predetermined separation distance from each other and inclined with respect to the flow-down direction of the flowing water flowing in from the confluent pipe.

According to the sixth invention, the impurity removing device is composed of a filtration screen including a plurality of screen bars provided at a predetermined separation distance from each other and inclined with respect to the flow-down direction of the flowing water flowing in from the confluent pipe. Thus, the flowing water flows to pass between the screen bars and is led to the dirty water pipe, but the impurities are subjected to the action of the inertial force directing in the main flow direction and therefore do not move to the screen bar side. As a result of this, it is possible to prevent the impurities from moving to the flow throttle portion side. Further, an impurity removing device with a simple structure can be obtained by using the filtration screen.

A seventh invention is characterized, in the flowing water splitting apparatus of the fifth invention, in that an impurity collecting device collecting the impurities is provided in the second flowing water channel and at a position below the adjusting weir.

According to the seventh invention, an impurity collecting device collecting the impurities is provided in the second flowing water channel and at a position below the adjusting weir, so that the impurities can be collected before the impurities enter the rainwater pipe. Thus, it is possible to easily collect the impurities and to prevent a situation in which the impurities clog the rainwater pipe to decrease the drainage function of the rainwater pipe.

An eighth invention is a flowing water splitting method using a flowing water splitting apparatus including a first flowing water channel including a weir defining a water quantity of flowing water flowing in from a confluent pipe and leading the flowing water flowing in from the confluent pipe to a dirty water pipe; a second flowing water channel leading flowing water flowing over the weir to a rainwater pipe; a partition wall portion provided to block the flowing water flowing through the first flowing water channel to form a plurality of water diversion chambers partitioned in the first flowing water channel; and a flow throttle portion formed in the partition wall portion to throttle a flow quantity of the flowing water flowing from one of the water diversion chambers into another of the water diversion chambers, for splitting the flowing water flowing in from the confluent pipe and conveying the water to the dirty water pipe and the rainwater pipe, wherein when flowing water in a water quantity greater than a predetermined quantity flows in from the confluent pipe, the flowing water is led to the dirty water pipe along the first flowing water channel while a flow quantity of the flowing water flowing in from the confluent pipe is being throttled by the flow throttle portion, and the flowing water stored in the plural water division chambers and flowing over the weir is led to the rainwater pipe along the second flowing water channel.

According to the eighth invention, the flowing water flowing in from the confluent pipe flows through the first flowing water channel in which its flow path is blocked by the partition wall portion and its flow quantity is throttled by the flow throttle portion. Thus, the flowing water in a part of the flow quantity reaches the dirty water pipe and is conveyed to the sewage treatment apparatus. Further, when flowing water in a water quantity greater than a predetermined quantity flows in from the confluent pipe, flowing of the most of the flowing water into the dirty water pipe is suppressed by the flow throttle portion and it is thus stored in the water diversion chambers. Then, after the flowing water is increasingly stored in the water diversion chamber, the water level of the flowing water therein finally exceeds the weir so that the flowing water overflows. The overflowing flowing water flows through the second flowing water channel to reach the rainwater pipe and is conveyed to the public water area such as a river or the like.

As described above, the flowing water flowing from the confluent pipe into the first flowing water channel is apt to be stored in the water diversion chambers because the flow-down quantity of the flowing water further flowing down through the first flowing water channel is suppressed by the flow throttle portion. Then, the flowing water stored in the water diversion chamber flows through the second flowing water channel to be led to the rainwater pipe. Therefore, the most of the flowing water flowing from the confluent pipe into the first flowing water channel is led to the rainwater pipe, and a part of it is led to the dirty water pipe. Thus, the flowing water quantity of the flowing water conveyed from the dirty water pipe to the sewage treatment apparatus can be reduced to decrease the operation load or the treatment load on the sewage treatment apparatus. As a result of this, the splitting function for the flowing water can be enhanced by the flowing water splitting apparatus with a simple structure, resulting in avoidance of an increase in size of the sewage treatment apparatus and suppress an increase in the manufacturing cost and the running cost (facility cost). Further, it is possible to suppress an increase in size of the flowing water splitting apparatus to prevent an increase in the manufacturing cost and the running cost of the flowing water splitting apparatus.

A ninth invention is characterized, in the flowing water splitting method of the eighth invention, in that a plurality of the partition wall portions are provided in a flow-down direction of the flowing water flowing through the first flowing water channel, that the plural water diversion chambers are successively formed along the flow-down direction of the flowing water, that the flowing water is led to the dirty water pipe along the first flowing water channel while the flow quantity of the flowing water flowing in from the confluent pipe is being throttled by a plurality of the flow throttle portions, and that the flowing water stored in the plural water division chambers and flowing over the weir is led to the rainwater pipe along the second flowing water channel.

According to the ninth invention, a plurality of the partition wall portions are provided in a flow-down direction of the flowing water flowing through the first flowing water channel, so that at least three or more water diversion chambers are formed. Then, the three or more water diversion chambers are successively (serially) formed along the flow-down direction of the flowing water. Therefore, the flowing water flowing in from the confluent pipe passes through at least the three water diversion chambers and its flow quantity is throttled by at least two flow throttle portions until the flowing water flows through the first flowing water channel to reach the dirty water pipe. This reduces the water quantity of the flowing water flowing through the first flowing water channel as it is to reach the dirty water pipe, and increases the water quantity of the flowing water flowing over the weir and flowing through the second flowing water channel to the rainwater pipe. In other words, the flow quantity of the flowing water flowing to the rainwater pipe is much greater than the flow quantity of the flowing water flowing to the dirty water pipe. As described above, the flowing water splitting apparatus with a simple structure can be used to further enhance the splitting function of splitting the flowing water flowing to the rainwater pipe and the flowing water flowing to the dirty water pipe.

A tenth invention is characterized, in the flowing water splitting method of the eighth invention or the ninth invention, in that the flow throttle portion is an orifice, and that the flowing water flowing in from the confluent pipe is led to the dirty water pipe while the flow quantity thereof is being throttled by the orifice.

According to the tenth invention, the flow throttle portion is an orifice, so that the flow quantity of the flowing water can be throttled only by forming the orifice in the partition wall portion. This makes it unnecessary to separately provide a device for throttling the flow quantity of the flowing water and possible to suppress an increase in size of the flowing water splitting apparatus, leading to prevention of an increase in the manufacturing cost and the running cost of the flowing water splitting apparatus.

An eleventh invention is a sewage system including a first flowing water splitting apparatus splitting flowing water flowing in from a confluent pipe; a second flowing water splitting apparatus connected to the first flowing water splitting apparatus via a first pipe so that a part of the flowing water split by the first flowing water splitting apparatus is led thereto via the first pipe, for splitting the part of the flowing water; a flowing water treatment apparatus connected to the second flowing water splitting apparatus via a second pipe so that a part of the flowing water split by the second flowing water splitting apparatus is led thereto via the second pipe, for purifying the part of the flowing water; and a water storage apparatus connected to the second flowing water splitting apparatus via a third pipe and connected to the flowing water treatment apparatus via a fourth pipe so that a part of the flowing water split by the second flowing water splitting apparatus is led thereto via the third pipe, for temporarily storing the part of the flowing water therein and conveying the part of the flowing water to the flowing water treatment apparatus via the fourth pipe, wherein the first flowing water splitting apparatus includes: a first flowing water channel including a weir defining a water quantity of the flowing water flowing in from the confluent pipe and leading flowing water not flowing over the weir of the flowing water flowing in from the confluent pipe to the first pipe; a second flowing water channel leading flowing water flowing over the weir of the flowing water flowing in from the confluent pipe to a public water area; a partition wall portion provided to block the flowing water flowing through the first flowing water channel to form a plurality of water diversion chambers partitioned in the first flowing water channel; and a flow throttle portion formed in the partition wall portion to throttle a flow quantity of the flowing water flowing from one of the water diversion chambers into another of the water diversion chambers, and wherein the second flowing water splitting apparatus includes: a first flowing water channel including a weir defining a water quantity of the flowing water flowing in from the first pipe and leading flowing water not flowing over the weir of the flowing water flowing in from the first pipe to the second pipe; a second flowing water channel leading flowing water flowing over the weir of the flowing water flowing in from the first pipe to the third pipe; a partition wall portion provided to block the flowing water flowing through the first flowing water channel to form a plurality of water diversion chambers partitioned in the first flowing water channel; and a flow throttle portion formed in the partition wall portion to throttle a flow quantity of the flowing water flowing from one of the water diversion chambers into another of the water diversion chambers.

According to the eleventh invention, flowing water not flowing over the weir of the flowing water flowing from the confluent pipe into the first flowing water splitting apparatus is led to the first pipe through the first flowing water channel. Flowing water flowing over the weir of the flowing water flowing from the confluent pipe into the first flowing water splitting apparatus is led to the public water area through the second flowing water channel. Further, flowing water not flowing over the weir of the flowing water flowing from the first pipe into the second flowing water splitting apparatus is led to the second pipe through the first flowing water channel. Flowing water flowing over the weir of the flowing water flowing from the first pipe into the second flowing water splitting apparatus is led to the third pipe through the second flowing water channel. The flowing water led to the second pipe is led to the flowing water treatment apparatus and subjected to purifying treatment. The flowing water led to the third pipe is led to the water storage apparatus. The flowing water led to the water storage apparatus is temporarily stored therein and periodically conveyed to the flowing water treatment apparatus in accordance with the treatment condition of the flowing water treatment apparatus.

Here, since the splitting function of the first flowing water splitting apparatus is high, most of the flowing water flowing into the first flowing water splitting apparatus flows over the weir and is led to the public water area through the second flowing water channel. This can significantly reduce the water quantity of the flowing water led from the first pipe to the second flowing water splitting apparatus through the first flowing water channel of the first flowing water splitting apparatus.

Further, since the splitting function of the second flowing water splitting apparatus is high, most of the flowing water flowing into the second flowing water splitting apparatus flows over the weir and is led to the water storage apparatus through the second flowing water channel and the third pipe. This can reduce the water quantity of the flowing water led from the second pipe to the flowing water treatment apparatus through the first flowing water channel of the second flowing water splitting apparatus.

In the above-described manner, the water quantity of the flowing water led to the flowing water treatment apparatus at a time can be significantly reduced, so that the facility cost, the maintenance cost and the running cost of the flowing water treatment apparatus can be reduced. Further, since a large quantity of flowing water is drained to the public water area because of improvement in the splitting function of the first flowing water splitting apparatus and the flowing water is further split by the second flowing water splitting apparatus, the water quantity of the flowing water flowing into the water storage apparatus can also be significantly reduced. Thus, the facility cost, the maintenance cost, and the running cost of the water storage apparatus can be reduced, A twelfth invention is preferable, in the sewage system of the eleventh invention, that a plurality of the partition wall portions of the first flowing water splitting apparatus are provided in a flow-down direction of the flowing water flowing through the first flowing water channel, and the plural water diversion chambers are successively formed along the flow-down direction of the flowing water, and that a plurality of the partition wall portions of the second flowing water splitting apparatus are provided in a flow-down direction of the flowing water flowing through the first flowing water channel, and the plural water diversion chambers are successively formed along the flow-down direction of the flowing water A thirteenth invention is preferable, in the sewage system of the eleventh invention or the twelfth invention, that the flow throttle portion of the first flowing water splitting apparatus is an orifice, and that the flow throttle portion of the second flowing water splitting apparatus is an orifice.

According to the present invention, the flow quantity splitting function for sewage (flowing water) can be enhanced by a simple structure to reduce the flow quantity of the sewage (flowing water) flowing to a dirty water pipe.

DETAILED DESCRIPTION OF PREFERRED EMBODIMENTS

Figure 1:
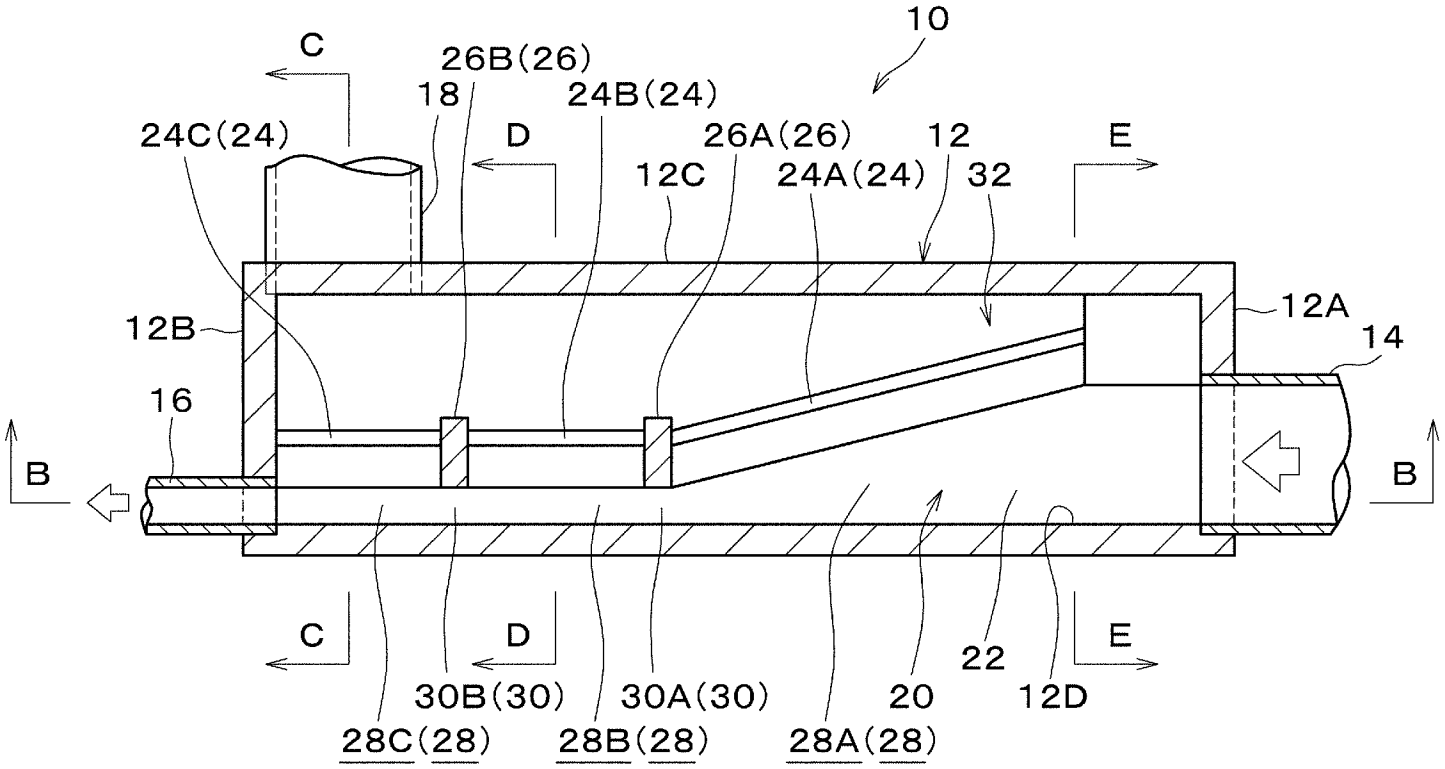
FIG. 1 is a plane sectional view (sectional view taken along A-A in FIG. 2) of a flowing water splitting apparatus according to a first embodiment of the present invention (in a state in which flowing water in a flow quantity equal to or less than a predetermined quantity flows)

Next, a flowing water splitting apparatus according to a first embodiment of the present invention will be described with reference to the drawings.

As shown in FIG. 1 to FIG. 10, a flowing water splitting apparatus 10 of the first embodiment includes a flowing water splitting apparatus main body (also referred to as a housing or a casing, which applies to the following) 12 that is a box-shaped member. To a side wall portion 12A on one side of the flowing water splitting apparatus main body 12, a confluent pipe 14 is connected. From the confluent pipe 14, sewage as flowing water flows to the inside of the flowing water splitting apparatus main body 12. Note that the sewage means a mixture of rainwater and dirty water such as domestic waste water.

To a side wall portion 12B on the other side of the flowing water splitting apparatus main body 12 opposite the side wall portion 12A on one side, a dirty water pipe 16 is connected. The diameter of the dirty water pipe 16 is set to be smaller than the diameter of the confluent pipe 14, and the dirty water pipe 16 is connected to a position opposite the confluent pipe 14. Further, the dirty water pipe 16 is connected to a facility such as a sewage treatment apparatus and conveys a split part of the sewage flowing from the confluent pipe 14 into the flowing water splitting apparatus main body 12 to the sewage treatment apparatus as dirty water.

Further, to a side wall portion 12C other than the side wall portion 12A on one side and the side wall portion 12B on the other side of the flowing water splitting apparatus main body 12, a rainwater pipe 18 is connected. The diameter of the rainwater pipe 18 is set to be much larger than the diameter of the dirty water pipe 16 and set to be slightly larger than the diameter of the confluent pipe 14. Further, the rainwater pipe 18 is connected to a public water area such as a river or the like and conveys a split part of the sewage flowing from the confluent pipe 14 into the flowing water splitting apparatus main body 12 to the public water area such as a river or the like as rainwater.

Inside the flowing water splitting apparatus main body 12, a first flowing water channel 20 is formed. The first flowing water channel 20 is formed to extend from the side wall portion 12A on one side to the side wall portion 12B on the other side of the flowing water splitting apparatus main body 12. Thus, the sewage flowing from the confluent pipe 14 to the inside of the flowing water splitting apparatus main body 12 is supplied to the first flowing water channel 20, and a part of the sewage flows through the first flowing water channel 20 to move to the dirty water pipe 16 side.

Here, the first flowing water channel 20 has a flowing water channel bottom portion 22 extending from an inner wall portion of the flowing water splitting apparatus main body 12 and a weir 24 extending in the vertical direction from the flowing water channel bottom portion 22. Therefore, the first flowing water channel 20 is formed by the weir 24 functioning as a water channel wall on one side in the width direction and the inner wall portion of the flowing water splitting apparatus main body 12 functioning as a water channel wall on the other side in the width direction. The sewage flowing in from the confluent pipe 14 flows down on the flowing water channel bottom portion 22 of the first flowing water channel 20 toward the dirty water pipe 16 side. The height of the weir 24 is set to be a dimension to make the quantity of water (or the quantity of flow, which applies to the following) of the sewage flowing through the first flowing water channel 20 equal to or less than a predetermined quantity. Therefore, if the water quantity of the sewage flowing through the first flowing water channel 20 is greater than the predetermined quantity, a part of the sewage flowing through the first flowing water channel 20 flows over the weir 24 to enter a later-described second flowing water channel 32.

Here, principal parts of the present invention will be described.

As shown in FIG. 1 to FIG. 10, between the weir 24 and an inner wall portion 12D of the flowing water splitting apparatus main body 12 which constitute the first flowing water channel 20, a plurality of partition wall portions 26 are provided in a manner to block the sewage flowing on the first flowing water channel 20. In other words, each of the partition wall portions 26 has a function of closing the first flowing water channel 20. Therefore, on the first flowing water channel 20, a plurality of water diversion chambers 28 formed by being surrounded by the flowing water channel bottom portion 22 of the first flowing water channel 20, the weir 24, the inner wall portion of the flowing water splitting apparatus 12, and the partition wall(s) 26 are successively provided along the top of the first flowing water channel 20. The water diversion chambers 28 are composed of a first water diversion chamber 28A located on the most upstream side (confluent pipe 14 side) in the flow-down direction of the first flowing water channel 20, a third water diversion chamber 28C located on the most downstream side (dirty water pipe 16 side) in the flow-down direction of the first flowing water channel 20, and a second water diversion chamber 28B located between the first water diversion chamber 28A and the third water diversion chamber 28C. Further, the partition wall portions 26 are composed of a first partition wall portion 26A which partitions off the first water diversion chamber 28A and the second water diversion chamber 28B and a second partition wall portion 26B which partitions off the second water diversion chamber 28B and the third water diversion chamber 28C.

Further, the partition wall portions 26A and 26B are formed with orifices 30 as flow throttle portions penetrating the partition wall portions 26A and 26B in the thickness direction, respectively. Concretely, the orifices 30 are composed of a first orifice 30A formed in the first partition wall portion 26A which partitions off the first water diversion chamber 28A and the second water diversion chamber 28B and a second orifice 30B formed in the second partition wall portion 26B which partitions off the second water diversion chamber 28B and the third water diversion chamber 28C. Therefore, the first water diversion chamber 28A and the second water diversion chamber 28B communicate with each other through the first orifice 30A so that the sewage enters from the first water diversion chamber 28A into the second water diversion chamber 28B through the first orifice 30A. Further, the second water diversion chamber 28B and the third water diversion chamber 28C communicate with each other through the second orifice 30B so that the sewage enters from the second water diversion chamber 28B into the third water diversion chamber 28C through the second orifice 30B.

Here, the weir 24 functioning as a side wall portion on one side in the width direction of the first flowing water channel 20 is composed of a first weir portion 24A constituting a wall portion of the first water diversion chamber 28A, a second weir portion 24B constituting a wall portion of the second water diversion chamber 28B, and a third weir portion 24C constituting a wall portion of the third water diversion chamber 28C. Among the three weir portions 24A, 24B and 24C, the first weir portion 24A has the largest height, the second weir portion 24B has the next largest height, and the third weir portion 24C has the smallest height (the heights of the weirs: the third weir portion 24C<the second weir portion 24B<the first weir portion 24A). Further, among the three water diversion chambers 28A, 28B and 28C, the first water diversion chamber 28A has the largest capacity, the second water diversion chamber 28B has the next largest capacity, and the third water diversion chamber 28C has the smallest capacity (the capacities of the water diversion chambers: the third water diversion chamber 28C<the second water diversion chamber 28B<the first water diversion chamber 28A).

Further, the second flowing water channel 32 is formed in the flowing water splitting apparatus main body 12 and below the first flowing water channel 20. The second flowing water channel 32 is formed on the bottom portion of the flowing water splitting apparatus main body 12. A part of the sewage flowing over the weir 24 forming the first flowing water channel 20 falls down onto the second flowing water channel 32, and then flows down on the second flowing water channel 32 to move to the rainwater pipe 18 side.

Note that though a configuration in which the three water diversion chambers 28A, 28B and 28C and the two partition wall portions 26A and 26B (the orifices 30A and 30B) are provided in the flowing water splitting apparatus 10 is illustrated in the above-described configuration, the configuration is not limited to this one but a configuration may be employed in which four or more water diversion chambers are provided in series and the water diversion chambers are partitioned off by partition wall portions and made to communicate with each other through orifices that are flow throttle portions.

Further, though a configuration in which the orifices 30A and 30B are formed in the partition wall portions 26A and 26B as the flow throttle portions is illustrated in the above configuration, the configuration is not limited to this one but may be the one in which the flow throttle portions are slots (see FIG. 14) 34. The slots 34 are formed in the partition wall portions 26A and 26B but are open holes each having an open area varying along the flow-down direction of the sewage unlike the orifices.

Next, the hydraulic principles of the flowing water splitting apparatus 10 of this embodiment will be described.

(Principle 1)

Figure 11:
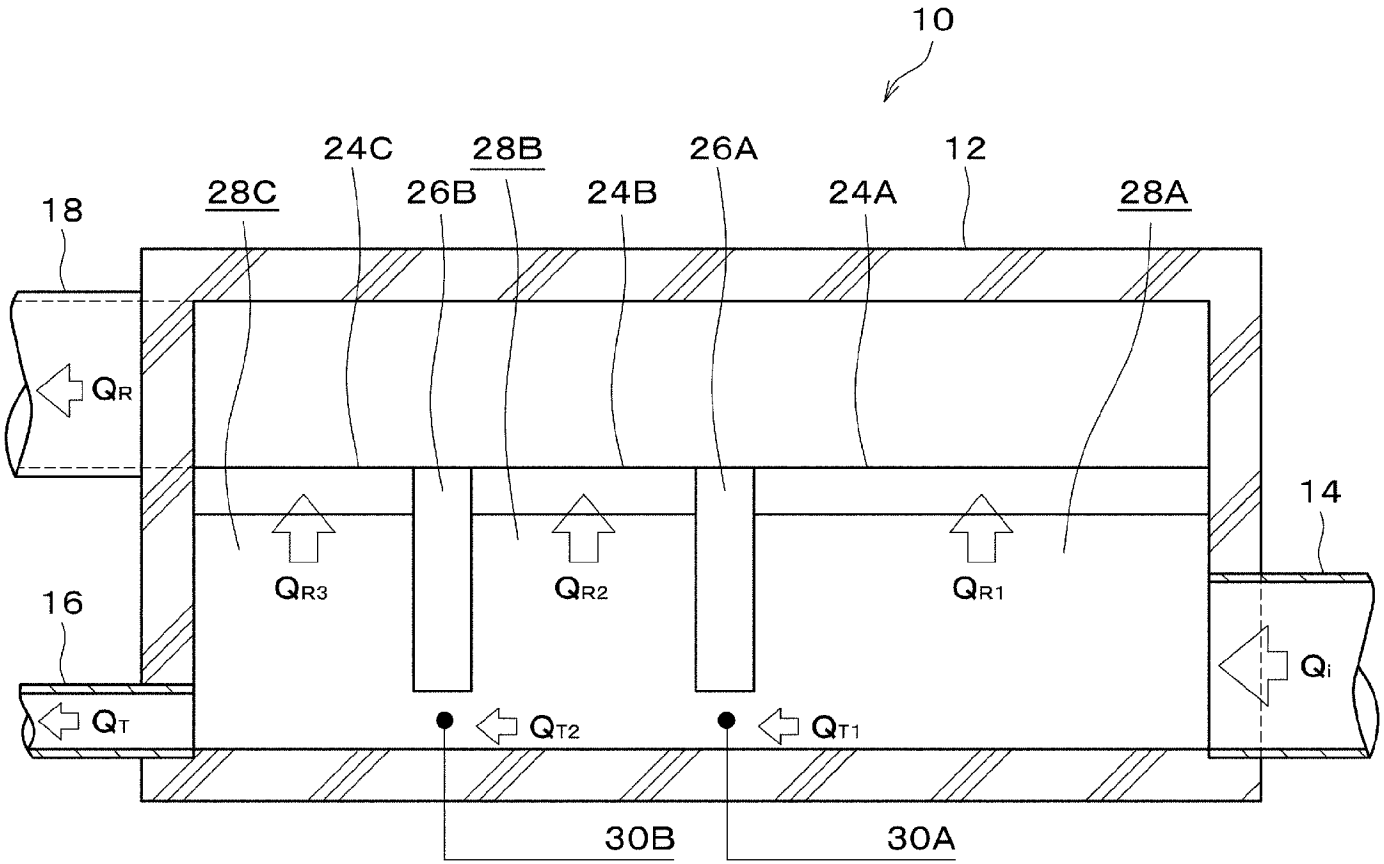
FIG. 11 is an explanatory view showing a flowing water splitting system of the flowing water splitting apparatus according to the first embodiment of the present invention.

As shown in FIG. 11, where the flow quantity of the sewage flowing in from the confluent pipe 14 is $Q_i$, the flow quantity of the dirty water flowing out of the dirty water pipe 16 is $Q_T$, and the flow quantity of the rainwater flowing out of the rainwater pipe 18 is $Q_R$, the water quantity flowing into the flowing water splitting apparatus main body 12 of the flowing water splitting apparatus 10 equals the water quantity flowing out of the flowing water splitting apparatus main body 12, resulting in $Q_i=Q_R+Q_T$.

(Principle 2)

An increase in the flow quantity of the sewage in each of the orifices 30A and 30B raises the water head of the sewage in each of the water diversion chambers 28A, 28B and 28C located upstream from the dirty water pipe 16 functioning as an orifice, or each of the orifices 30A and 30B by Δh to increase the depth of water (overflow) of the sewage in each of the water diversion chambers 28A, 28B and 28C. Here, as described later, the effect of the increase in the flow quantity of Δh exerts the flow quantity of the sewage passing through the dirty water pipe 16 or the orifice 30A, 30B by ½ (power), while exerting the flow quantity of the sewage flowing over each of the weir portions 24A, 24B and 24C by ⅔ (power). Further, the flow coefficient of the flow quantity of the sewage flowing over each of the weir portions 24A, 24B and 24C is three times greater than the flow coefficient of the flow quantity of the sewage passing through the dirty water pipe 16 or the orifice 30A, 30B. Therefore, the increase of Δh in the water head of the sewage in each of the water diversion chambers 28A, 28B and 28C influences the increase in the flow quantity of the sewage flowing over each of the weir portions 24A, 24B and 24C more greatly than the increase in the flow quantity of the sewage passing though the dirty water pipe 16 or the orifice 30A, 30B.

Figure 14:
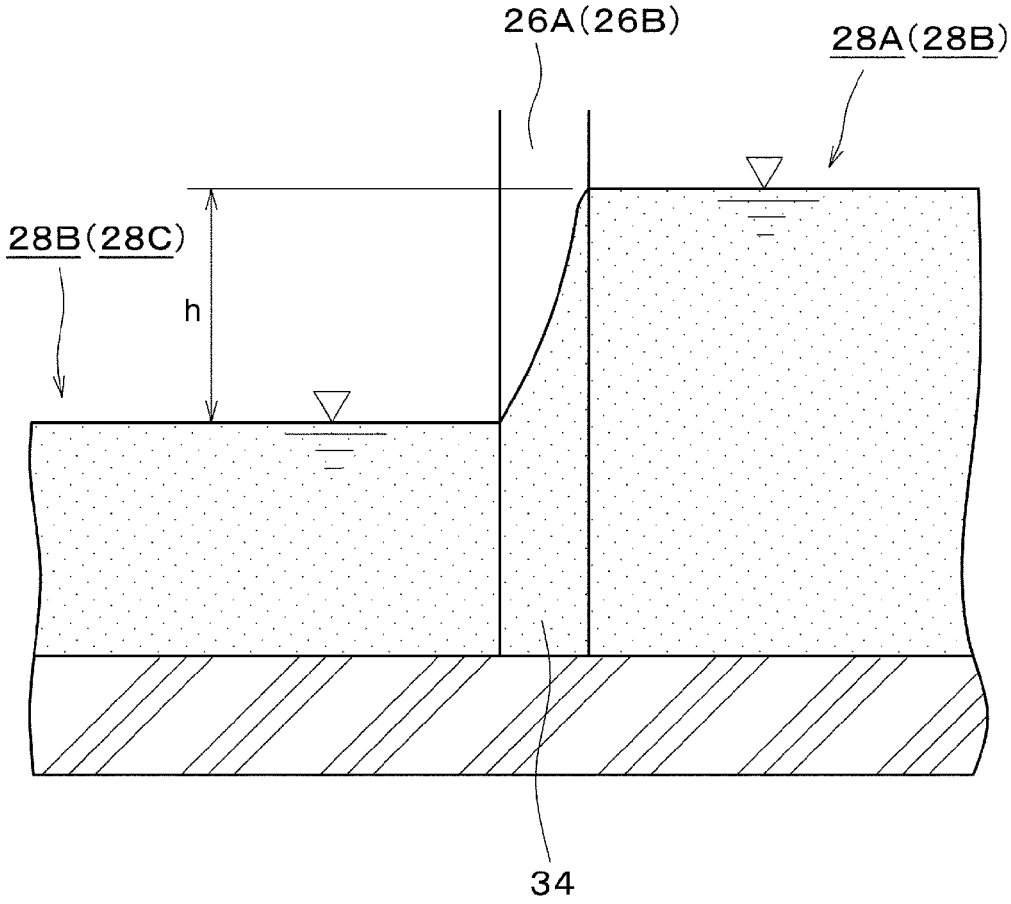
FIG. 14 is an explanatory view showing a hydraulic phenomenon of a slot type.

Further, the increase of Δh in the water head of the sewage in each of the water diversion chambers 28A, 28B and 28C similarly influences the increase in the flow quantity of the sewage flowing over each of the weir portions 24A, 24B and 24C more greatly than the increase in the flow quantity of the sewage passing though the slot 34 (see FIG. 14).

Figure 12:
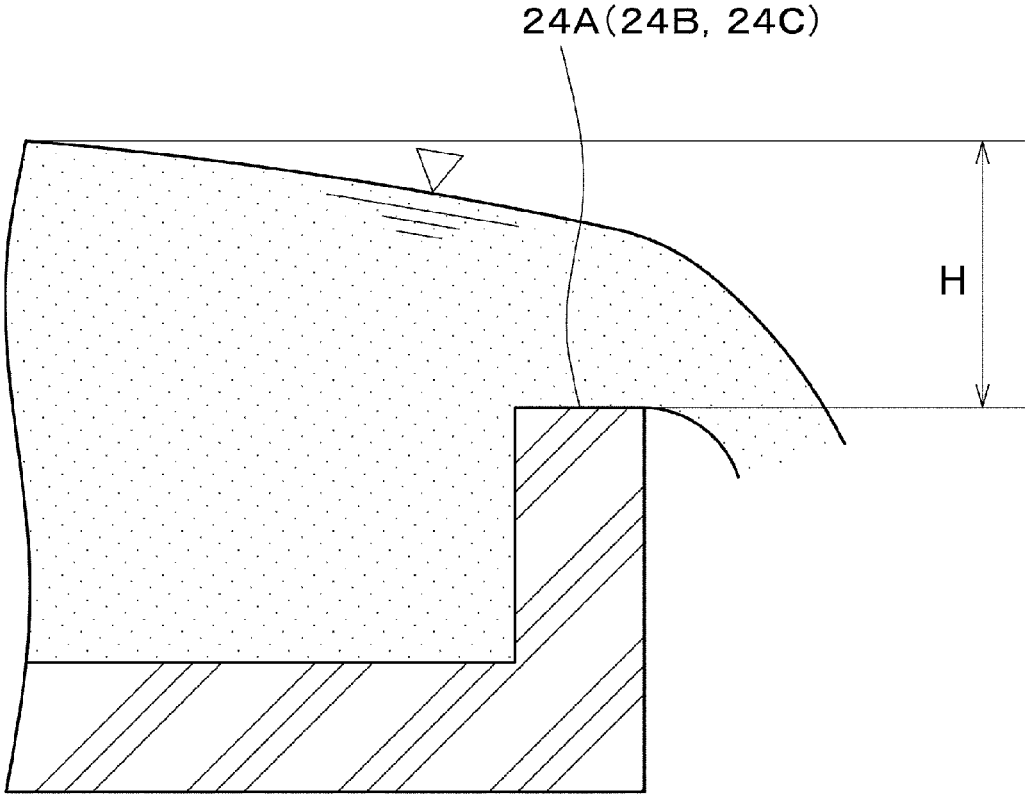
FIG. 12 is an explanatory view showing a hydraulic phenomenon of an overflowing weir type.

Here, as shown in FIG. 11 and FIG. 12, where the flow quantity of the sewage flowing over each of the weir portions 24A, 24B and 24C is $Q_R$ ($m^3$/S), the flow coefficient is $C_R$ (=general value 1.8), the overflow width is B (m), and the overflow water depth is H (m), the flow quantity of the sewage flowing over each of the weir portions 24A, 24B and 24C is calculated by $Q_R=C_R\times B\times(H)^{3/2}$.

Figure 13:
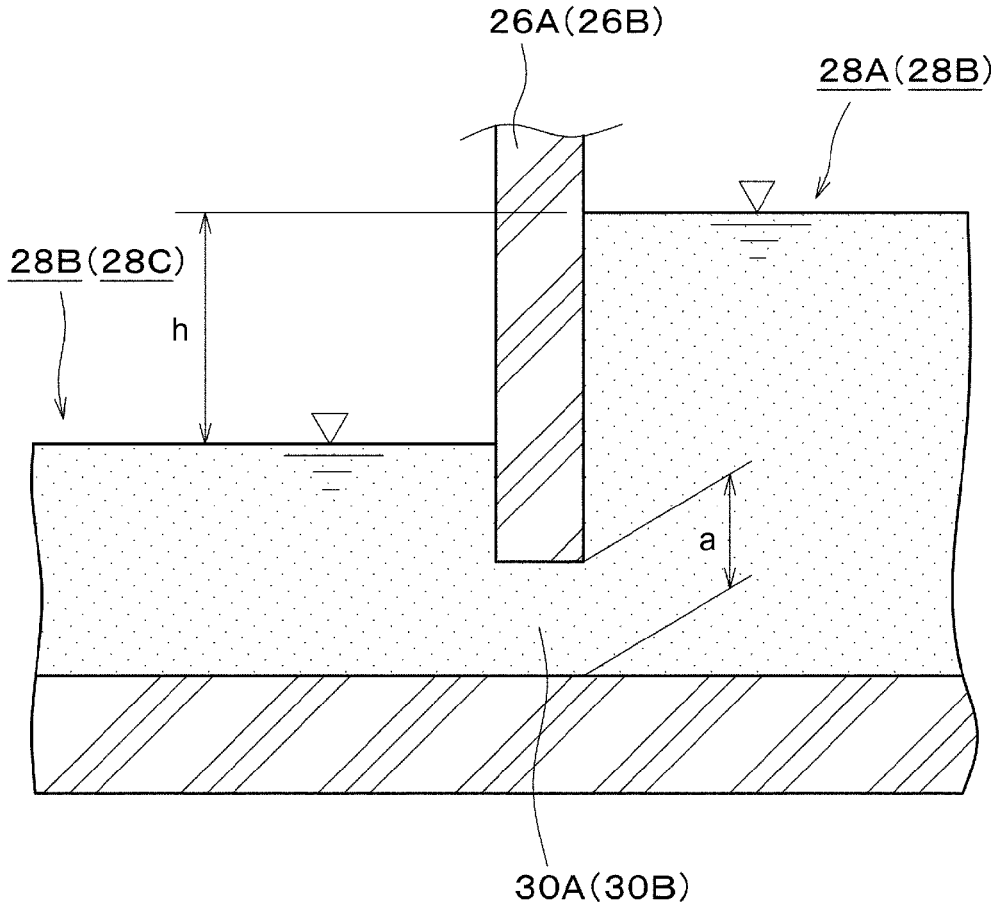
FIG. 13 is an explanatory view showing a hydraulic phenomenon of an orifice type.

As shown in FIG. 11 and FIG. 13, where the flow quantity of the sewage passing through the orifice 30A, 30B is $Q_T$($m^3$/S), the flow coefficient is $C_0$ (=general value 0.6), the orifice area is a ($m^2$), the water head difference is h (m), and the gravitational acceleration is g, the flow quantity of the sewage passing through the orifice 30A, 30B is calculated by $Q_T=C_0\times a\times(2\times g\times h)^{1/2}$.

As shown in FIG. 11 and FIG. 14, where the flow quantity of the sewage passing through the slot 34 is $Q_T'$ ($m^3$/S), the flow coefficient is $C_0'$ (=general value 0.75 to 0.85), the slot width is b (m), the water depth of the sewage in the upstream side water diversion chamber is y (m), the water head difference is h (m), and the gravitational acceleration is g, the flow quantity of the sewage passing through the slot 34 is calculated by $Q_T'=C_0'\times b\times y\times(2\times g\times h)^{1/2}$.

Next, the flowing water splitting function of the flowing water splitting apparatus 10 will be described.

Referring to FIG. 11, where the flow quantity of the sewage flowing out of the dirty water pipe 16 is $Q_T$, the flow quantity of the sewage flowing in from the confluent pipe 14 is $Q_i$, the flow quantity of the sewage flowing out over the first weir portion 24A of the first water diversion chamber 28A is $Q_{R1}$, the flow quantity of the sewage flowing out over the second weir portion 24B of the second water diversion chamber 28B is $Q_{R2}$, and the flow quantity of the sewage flowing out over the third weir portion 24C of the third water diversion chamber 28C is $Q_{R3}$, $Q_T=Q_i-(Q_{R1}+Q_{R2}+Q_{R3})$ is established from the principle 1. This means that the increase in the flow quantity of the sewage flowing out over each of the weir portions 24A, 24B and 24C decreases the flow quantity of the sewage flowing out of the dirty water pipe 16.

Referring to FIG. 11, the water depth of the sewage in each of the water diversion chambers 28A, 28B and 28C increases every time the sewage passes through each of the orifices 30A and 30B to decrease the flow quantity of the sewage reaching the dirty water pipe 16 from the principle 2. More specifically, where the flow quantity of the sewage passing through the first orifice 30A is $Q_{T1}$ and the flow quantity of the sewage passing through the second orifice 30B is $Q_{T2}$, and where the water depth of the sewage in the third water diversion chamber 28C is $h_3$ when the flow quantity of the sewage flowing out of the dirty water pipe 16 is $Q_T$, $Q_T+Q_{R3}=Q_{T2}$ is established in the second water diversion chamber 28B, so that the water depth $h_2$ of the sewage in the second water diversion chamber 28B is larger than the water depth $h_3$ of the sewage in the third water diversion chamber 28C ($h_3<h_2$). Further, $Q_{T2}+Q_{R2}=Q_{T1}$ is established in the first water diversion chamber 28A, so that the water depth $h_1$ of the sewage in the first water diversion chamber 28A is much larger than the water depth $h_2$ of the sewage in the second water diversion chamber 28B ($h_2<<h_1$). In addition, considering the confluent pipe 14, $Q_{T1}+Q_{R1}=Q_i$ is established. If the plural water diversion chambers 28A, 28B and 28C are arranged in series, the water depth of the sewage in the first water diversion chamber 28A closest to the confluent pipe 14 side greatly increases and the flow quantity of the sewage flowing over the first weir portion 24A greatly increases. Then, the water depth of the sewage in the second water diversion chamber 28B closest to the first water diversion chamber 28A side increases, and the flow quantity of the sewage flowing over the second weir portion 24B increases. Lastly, the water depth of the sewage in the third water diversion chamber 28C farthest from the confluent pipe 14 side increases, and the flow quantity of the sewage flowing over the third weir portion 24C slightly increases. As described above, the flow quantity of the sewage flowing over the first weir portion 24A of the first water diversion chamber 28A increases most greatly, then the flow quantity of the sewage flowing over the second weir portion 24B of the second water diversion chamber 28B increases, and lastly the flow quantity of the sewage flowing over the third weir portion 24C of the third water diversion chamber 28C increases.

The plural water diversion chambers 28A, 28B and 28C are formed to be partitioned in series on the first flowing water channel 20 along the flow-down direction of the sewage and the orifices 30A and 30B are formed in the respective partition wall portions 26A and 26B to pass the sewage therethrough as described above, whereby the flow quantity of the sewage flowing out over each of the weir portions 24A, 24B and 24C of the water diversion chambers 28A, 28B and 28C increases, with the result that the flow quantity of the sewage led to the rainwater pipe 18 can be increased. Thus, the most of the sewage flowing in from the confluent pipe 14 can be led to the rainwater pipe 18 and a small quantity of the sewage can be led to the dirty water pipe. As a result of this, the splitting function for the sewage flowing in from the confluent pipe 14 can be enhanced.

Next, the operation of the flowing water splitting apparatus 10 of this embodiment will be described.

As shown in FIG. 1 to FIG. 5, if the water quantity of the sewage flowing from the confluent pipe 14 into the flowing water splitting apparatus main body 12 is equal to or less than the predetermined quantity, the sewage flowing into the flowing water splitting apparatus main body 12 flows in sequence through the water diversion chambers 28A, 28B and 28C formed to be partitioned on the first flowing water channel 20 while passing through the orifices 30A and 30B. More specifically, the sewage first flows through the first flowing water channel 20 in the first water diversion chamber 28A and then passes through the first orifice 30A. At the time when the sewage passes through the first orifice 30A, the water depth of the sewage in the first water diversion chamber 28A gradually increases but the sewage never flows over the first weir portion 24A. Further, the sewage passed through the first orifice 30A enters the second water diversion chamber 28B and flows through the first flowing water channel 20, and finally reaches the second orifice 30B. Then, at the time when the sewage passes through the second orifice 30B, the water depth of the sewage in the second water diversion chamber 28B gradually increases but the sewage never flows over the second weir portion 24B. Further, the sewage passed through the second orifice 30B enters the third water diversion chamber 28C and flows through the first flowing water channel 20, and finally reaches the dirty water pipe 16. Then, at the time when the sewage flows through the dirty water pipe 16, the water depth of the sewage in the third water diversion chamber 28C gradually increases but the sewage never flows over the third weir portion 24C.

As described above, if the water quantity of the sewage flowing from the confluent pipe 14 into the flowing water splitting apparatus main body 12 is equal to or less than the predetermined quantity, the sewage never flows over the weir portions 24A, 24B and 24C and flows through the second flowing water channel 32 to enter the rainwater pipe 18, but all the sewage flowing from the confluent pipe 14 into the flowing water splitting apparatus main body 12 enters the dirty water pipe 16 and is conveyed to the sewage treatment apparatus. Then, in the sewage treatment apparatus, predetermined treatment is performed on the sewage.

On the other hand, if the water quantity of the sewage flowing from the confluent pipe 14 into the first water diversion chamber 28A of the flowing water splitting apparatus main body 12 is greater than the predetermined quantity as shown in FIG. 6 to FIG. 10, the sewage flowing into the first water diversion chamber 28A of the flowing water splitting apparatus main body 12 flows through the first flowing water channel 20 and then passes through the first orifice 30A, and the water depth of the sewage in the first water diversion chamber 28A gradually increases because the flow quantity of the sewage flowing into the flowing water splitting apparatus main body 12 increases, and finally the sewage flows over the first weir portion 24A. The sewage flowing over the first weir portion 24A flows through the second flowing water channel 32 to enter the rainwater pipe 18 and is conveyed to the public water area such as a river or the like. As described above, if the water quantity of the sewage flowing from the confluent pipe 14 into the flowing water splitting apparatus main body 12 is greater than the predetermined quantity, the sewage flowing into the flowing water splitting apparatus main body 12 is split in the first water diversion chambers 28A.

The sewage passing through the first orifice 30A and entering the second water diversion chamber 28B flows through the first flowing water channel 20 toward the second orifice 30B side. Then, the sewage passes through the second orifice 30B, and the water depth of the sewage in the second water diversion chamber 28B gradually increases because the flow quantity of the sewage flowing into the flowing water splitting apparatus main body 12 increases, and finally the sewage flows over the second weir portion 24B. The sewage flowing over the second weir portion 24B flows through the second flowing water channel 32 to enter the rainwater pipe 18 and is conveyed to the public water area such as a river or the like. As described above, if the water quantity of the sewage flowing from the confluent pipe 14 into the flowing water splitting apparatus main body 12 is greater than the predetermined quantity, the sewage flowing into the flowing water splitting apparatus main body 12 is split also in the second water diversion chambers 28B.

The sewage passing through the second orifice 30B and entering the third water diversion chamber 28C flows through the first flowing water channel 20 toward the dirty water pipe 16 side. Then, the sewage passes through the second orifice 30B, and the water depth of the sewage in the third water diversion chamber 28C gradually increases because the flow quantity of the sewage flowing into the flowing water splitting apparatus main body 12 increases, and finally the sewage flows over the third weir portion 24C. The sewage flowing over the third weir portion 24C flows through the second flowing water channel 32 to enter the rainwater pipe 18 and is conveyed to the public water area such as a river or the like. As described above, if the water quantity of the sewage flowing from the confluent pipe 14 into the flowing water splitting apparatus main body 12 is greater than the predetermined quantity, the sewage flowing into the flowing water splitting apparatus main body 12 is split also in the third water diversion chambers 28C.

Note that the sewage flowing from the third water diversion chamber 28C into the dirty water pipe 16 is conveyed to the sewage treatment apparatus. Then, predetermined treatment is performed on the sewage in the sewage treatment apparatus. As described above, a part of the sewage flowing from the confluent pipe 14 into the first water diversion chamber 28A of the flowing water splitting apparatus main body 12 is conveyed as dirty water from the dirty water pipe 16 to the sewage treatment apparatus, and the most of the sewage flowing from the confluent pipe 14 into the first water diversion chamber 28A of the flowing water splitting apparatus main body 12 is conveyed as rainwater from the rainwater pipe 18 to the public water area such as a river or the like.

Next, the above-described hydraulic phenomenon will be described from the point of view of energy conservation law.

Note that the following description will be made on the basis of the downstream side of the flow-down direction of the sewage flowing through the inside of the flowing water splitting apparatus main body 12 in the case where the water quantity of the sewage flowing from the confluent pipe 14 into the first water diversion chamber 28A of the flowing water splitting apparatus main body 12 is greater than the predetermined quantity.

As shown in FIG. 11, the water level of the sewage in the third water diversion chamber 28C which allows a predetermined water quantity of the sewage to flow into the dirty water pipe 16 is set by a non-uniform flow calculation in the dirty water pipe 16. This water level is higher than the third weir portion 24C so that the overflow quantity of the sewage flowing over the third weir portion 24C is supplied to the second flowing water channel 32 as it is.

The flow quantity of the sewage passing through the second orifice 30B from the second water diversion chamber 28B is the flow quantity obtained by adding the flow quantity of the sewage flowing out of the dirty water pipe 16 and the flow quantity of the sewage flowing over the third weir portion 24C. Therefore, it is necessary to store the sewage of the added flow quantities (the sewage of a flow quantity greater than the flow quantity of the sewage stored in the third water diversion chamber 28C) in the second water diversion chamber 28B, so that the water level of the sewage in the second water diversion chamber 28B accordingly becomes higher. Therefore, the flow quantity of the sewage flowing over the second weir portion 24B is a large overflow quantity (an overflow quantity greater than the flow quantity over the third weir portion 24C) corresponding to the increment in the flow quantity of the sewage (the increment in the water level), and the overflow quantity is supplied to the second flowing water channel 32 as it is.

The flow quantity of the sewage passing through the first orifice 30A from the first water diversion chamber 28A is the flow quantity obtained by adding the flow quantity of the sewage passing through the second orifice 30B and the flow quantity of the sewage flowing over the second weir portion 24B. Therefore, it is necessary to store the sewage of the added flow quantities (the sewage of a flow quantity greater than the flow quantity of the sewage stored in the second water diversion chamber 28B) in the first water diversion chamber 28A, so that the water level of the sewage in the first water diversion chamber 28A accordingly becomes higher. Therefore, the flow quantity of the sewage flowing over the first weir portion 24A is a large overflow quantity (an overflow quantity greater than the flow quantity over the second weir portion 24B) corresponding to the increment in the flow quantity of the sewage (the increment in the water level), and the overflow quantity is supplied to the second flowing water channel 32 as it is.

As described above, the plural water diversion chambers 28A, 28B and 28C, the orifices 30A and 30B as the plural flow throttle portions, and the plural weir portions 24A, 24B and 24C are provided in the flowing water splitting apparatus 10 and they are organically combined, whereby the splitting function for the sewage can be enhanced. As a result of this, the treatment load on the sewage treatment apparatus connected to the dirty water pipe 16 can be reduced to significantly reduce the facility investment.

In particular, through use of the orifice or slot as the flow throttle portion, the flow throttle portion can be formed only by providing a through hole in the partition wall portion, thereby making it unnecessary to separately provide a device as the flow throttle portion. As a result of this, the manufacturing cost and the running cost of the flowing water splitting apparatus 10 can be reduced, and an increase in size thereof can also be avoided.

Next, a flowing water splitting apparatus according to a second embodiment of the present invention will be described.

Note that description of the configuration and operation and effect similar to those of the flowing water splitting apparatus 10 of the first embodiment will be appropriately omitted.

As shown in FIG. 15 to FIG. 18, a flowing water splitting apparatus 50 of the second embodiment includes a flowing water splitting apparatus main body (also referred to as a housing or a casing, which applies to the following) 52 that is a box-shaped member. To a side wall portion 52A on one side of the flowing water splitting apparatus main body 52, a confluent pipe 54 is connected. From the confluent pipe 54, sewage as flowing water flows to the inside of the flowing water splitting apparatus main body 52.

To another side wall portion 52B perpendicular to the side wall portion 52A on one side of the flowing water splitting apparatus main body 52, a dirty water pipe 56 is connected.

The diameter of the dirty water pipe 56 is set to be smaller than the diameter of the confluent pipe 54. Further, the dirty water pipe 56 is connected to a facility such as a sewage treatment apparatus and conveys a split part of the sewage flowing from the confluent pipe 54 into the flowing water splitting apparatus main body 52 to the sewage treatment apparatus as dirty water.

Further, to a side wall portion on the other side of the flowing water splitting apparatus main body 52 opposite the side wall portion 52A on one side, a rainwater pipe 82 is connected. The diameter of the rainwater pipe 82 is set to be much larger than the diameter of the dirty water pipe 56 and set to be the same as the diameter of the confluent pipe 54. Further, the rainwater pipe 82 is connected to a public water area such as a river or the like and conveys a split part of the sewage flowing from the confluent pipe 54 into the flowing water splitting apparatus main body 52 to the public water area such as a river or the like as rainwater.

Inside the flowing water splitting apparatus main body 52, a first flowing water channel 58 formed in an almost L-shape in plan view (see FIG. 15) is provided. A plurality of partition wall portions 60 and a plurality of weirs 62 are provided on the first flowing water channel 58, so that they form a plurality of water diversion chambers 64 successively along the flow-down direction of the sewage. More specifically, two partition wall portions 60A and 60B are provided on the first flowing water channel 58 so that three water diversion chambers 64A, 64B and 64C are formed to be partitioned.

The first water diversion chamber 64A is formed in an almost L-shape in plan view (see FIG. 15) and is formed on the first flowing water channel 58 to be partitioned off by a first weir portion 62A in an almost L-shape in plan view (see FIG. 15), a first adjusting weir portion 62D in an almost L-shape in plan view (see FIG. 15) opposite the first weir portion 62A, and the first partition wall portion 60A. The first water diversion chamber 64A is in communication with the confluent pipe 54.

The second water diversion chamber 64B is formed on the first flowing water channel 58 to be partitioned off by a second weir portion 62B in an almost L-shape in plan view (see FIG. 15), a second adjusting weir portion 62E linearly extending, the first partition wall portion 60A, and the second partition wall portion 60B.

The third water diversion chamber 64C is formed on the first flowing water channel 58 to be partitioned off by a third weir portion 62C in an inverted L-shape in plan view (see FIG. 15), a third adjusting weir portion 62F linearly extending, the second partition wall portion 60B, and the side wall portion 52B of the flowing water splitting apparatus main body 52. The third water diversion chamber 64C is in communication with the dirty water pipe 56.

The first water diversion chamber 64A is located near the confluent pipe 54 and on the most upstream side in the flow-down direction of the first flowing water channel 58, the third water diversion chamber 64C is located near the dirty water pipe 56 and on the most downstream side in the flow-down direction of the first flowing water channel 58, and the second water diversion chamber 64B is located between the first water diversion chamber 64A and the third water diversion chamber 64C such that the water diversion chambers 64A, 64B and 64C are formed in series along the flow-down direction of the sewage flowing through the first flowing water channel 58.

Further, the first partition wall portion 60A is formed with a first orifice 66A so that the first water diversion chamber 64A and the second water diversion chamber 64B are in communication with each other. Further, the second partition wall portion 60B is similarly formed with a second orifice 66B so that the second water diversion chamber 64B and the third water diversion chamber 64C are in communication with each other.

Here, on the first water diversion chamber 64, a pair of filtration screens 70A and 70B (impurity removing devices) opposed each other are provided. The filtration screens 70A and 70B are provided to extend along a main flow direction (an X-direction with an arrow in FIG. 15 and FIG. 18) that is the inflow direction of the sewage flowing in from the confluent pipe 54. Therefore, the first water diversion chamber 64A is partitioned by the filtration screens 70A and 70B into two chambers, that is, a large capacity chamber 68A and a small capacity chamber 68B communicating with it at the bottom portion of the large capacity chamber 68A. Note that the flow-down direction of the sewage flowing through the small capacity chamber 68B of the first water diversion chamber 64A, the second water diversion chamber 64B, and the third water diversion chamber 64C is defined as a branch direction (a Y-direction with an arrow in FIG. 15 and FIG. 16) with respect to the main flow direction.

The main flow direction of the sewage coincides with the inflow direction of the sewage flowing from the confluent pipe 54 to the inside of the flowing water splitting apparatus main body 52, and is the direction in which the momentum accompanied by the flowing down of the sewage directly exerts. On the other hand, the branch direction of the sewage is a direction perpendicular to the main flow direction of the sewage in which the momentum accompanied by the flowing down of the sewage is not directly transmitted. Therefore, the sewage tries to flow along the main flow direction, so that the most of the sewage flows down toward the first adjusting weir portion 62D, and a part of the sewage flows in the branch direction passing through the filtration screen 70B and moves to the small capacity chamber 68B side of the first water diversion chamber 64A.

Figure 18:
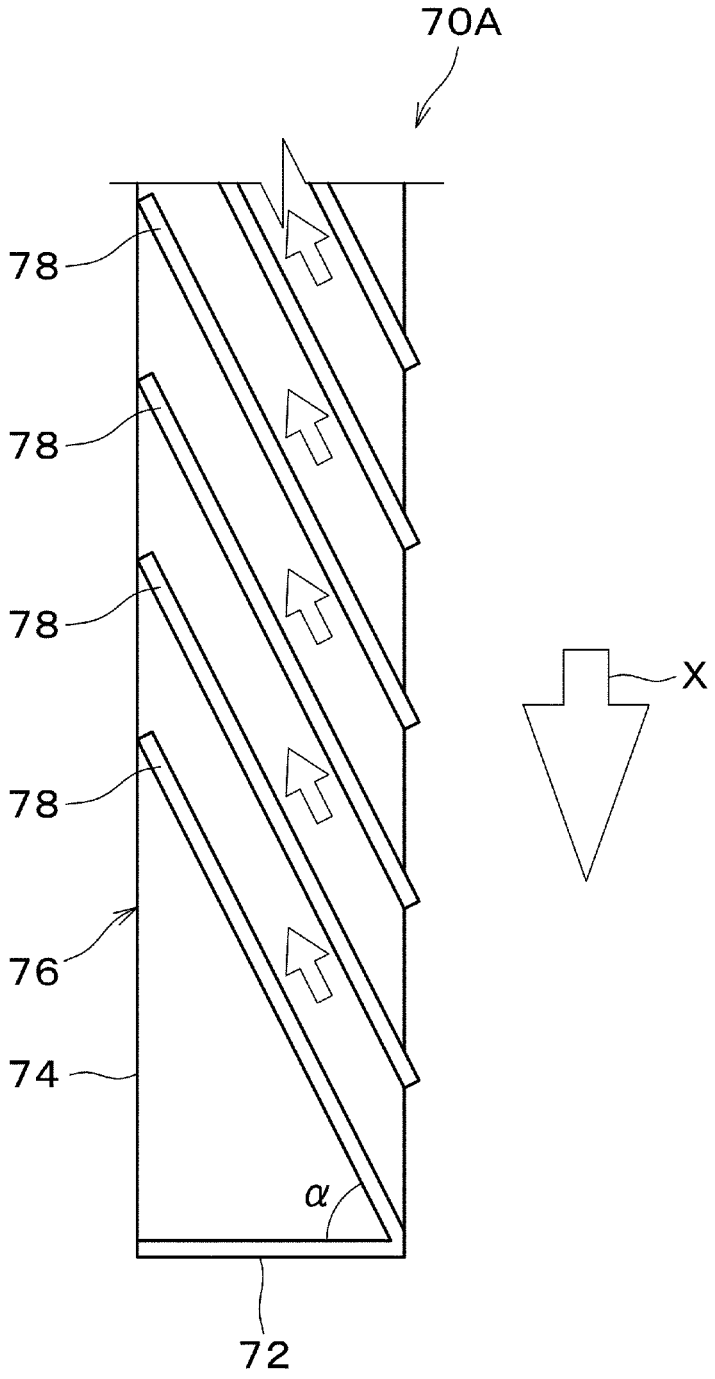
FIG. 18 is a configuration diagram of a part of an impurity removing device used in the flowing water splitting apparatus according to the second embodiment of the present invention.

As shown in FIG. 18, the filtration screen 70A includes an outer frame 76 formed by assembling a screen vertical outer frame 72 and a screen horizontal outer frame 74. Further, inside the outer frame 76, a plurality of screen bars 78 are provided in parallel at predetermined intervals. Further, the screen vertical outer frame 72, the screen horizontal outer frame 74, and the screen bars 78 are made of steel material or vinyl chloride material. Note that the filtration screen 70B has the same configuration as that of the first filtration screen 70A.

The interval between the plural screen bars 78 is set to be a size which does not allow entry of impurities. Further, each of the screen bars 78 inclines to open from the downstream side to the upstream side of the main flow direction (the X-direction with an arrow in FIG. 15 and FIG. 18) of the sewage. Concretely, an inclination angle $\alpha$ of each of the screen bars 78 is set to be an obtuse angle open from the downstream side to the upstream side of the main stream direction (the X-direction with an arrow in FIG. 15 and FIG. 18). As described above, each of the screen bars 78 has the inclination direction toward the opposite side with respect to the main flow direction of the swage and is configured such that the impurities contained in the sewage flowing in the main flow direction do not enter the space between the screen bars 78. In addition, the filtration screens 70A and 70B are provided at positions where the sewage flows along the main flow direction in the large capacity chamber 68A, so that the impurities contained in the sewage do not stay in the vicinity of the filtration screens 70A and 70B. This makes it possible to prevent the impurities from clogging the space between the screen bars 78 of the filtration screens 70A and 70B and to allow a part of the sewage to pass through the space between the screen bars 78 at all times. As a result of this, a poor condition of the filtration screens 70A and 70B due to the impurities is never caused, and the maintenance of the filtration screens 70A and 70B is unnecessary.

As shown in FIG. 15 to FIG. 18, a second flowing water channel 80 is formed below the first flowing water channel 58. The second flowing water channel 80 is in communication with the rainwater pipe 82. On the second flowing water channel 80 and below the first adjusting weir portion 62D, a first collecting device 84 which collects the impurities is provided. Further, inside the first collecting device 84, a second collecting device 86 is provided. Furthermore, inside the second collecting device 86, a third collecting device 88 is provided.

The capacities of the collecting devices 84, 86 and 88 are set such that the first collecting device 84 has the largest capacity and the third collecting device 88 has the smallest capacity. More specifically, the capacities of the collecting devices 84, 86 and 88 increase in order of the third collecting device 88 located innermost, the second collecting device 86 located between the other two collecting devices, and the first collecting device 84 located outermost.

Further, each of the collecting devices 84, 86 and 88 is configured by fixing an elastic and flexible mesh bag body to a support post made of steel. Here, the mesh sizes of the bog bodies of the collecting devices 84, 86 and 88 are set such that the mesh of the bag body of the first collecting device 84 is the smallest, the mesh of the bag body of the third collecting device 88 is the largest, and the mesh of the bag body of the second collecting device 86 is intermediate between them. Therefore, the mesh of the bag body of the third collecting device 88 located innermost is the largest, the mesh of the bag body of the second collecting device 86 is the next largest, and the mesh of the bag body of the first collecting device 84 located outermost is the smallest.

Next, the operation of the flowing water splitting apparatus 50 of second embodiment will be described.

Note that description of the operation overlapping that of the flowing water splitting apparatus 10 of the first embodiment will be appropriately omitted.

As shown in FIG. 15 to FIG. 18, the sewage flowing from the confluent pipe 54 into the flowing water splitting apparatus main body 52 of the flowing water splitting apparatus 50 flows down along the main flow direction through the large capacity chamber 68A of the first water diversion chamber 64A. In this event, because the screen bars 78 of the filtration screens 70A and 70B incline at an obtuse angle with respect to the main flow direction, the impurities contained in the flowing water never enter the small capacity chamber 68B through the space between the screen bars 78 but flow down along the main flow direction through the large capacity chamber 68A of the first water diversion chamber 64A. The sewage strikes the first adjusting weir portion 62D and the impurities stay there. As described above, the impurities contained in the sewage are pushed by the flowing force of the sewage to automatically move to the first adjusting weir portion 62D side and stay near the first adjusting weir portion 62D. Then, when the flow quantity of the sewage flowing in from the confluent pipe 54 further increases, the water level of the sewage in the large capacity chamber 68A rises, and finally the impurities flow over the first adjusting weir portion 62D and fall down into the third collecting device 88 provided in the second flowing water channel 80. The impurities fell down to the inside of the third collecting device 88 pass through the mesh of the third collecting device 88 and pass through the mesh of the second collecting device 86 according to the size, and move to the first collecting device 84. Note that the mesh of the bag body of the first collecting device 84 is set to be small, so that the impurities never pass through the mesh of the bag body of the first collecting device 84 to enter the rainwater pipe 82. As described above, the impurities flowing over the first adjusting weir portion 62D and falling down are sorted and collected in the three collecting devices 84, 86 and 88 according to the size (volume). As a result of this, the impurities contained in the sewage can be automatically collected without separately providing human or mechanical operation and management. Note that the sewage from which the impurities have been removed flows through the second flowing water channel 80 to enter the rainwater pipe 82 and is drained to the public water area such as a river or the like.

On the other hand, a part of the sewage flowing in the main flow direction through the large capacity chamber 68A passes between the screen bars to enter the small capacity chamber 68B of the first water diversion chamber 64A. The sewage entering the small capacity chamber 68B passes through the first orifice 66A to enter the second water diversion chamber 64B, and further passes through the second orifice 66B to enter the third water diversion chamber 64C. Then, the sewage enters the dirty water pipe 56 from the third water diversion chamber 64C and is conveyed to the sewage treatment apparatus.

Then, as in the flowing water splitting apparatus 10 of the first embodiment, when the flow quantity of the sewage entering the first water diversion chamber 64A increases, the water levels of the sewage in the large capacity chamber 68A and the small capacity chamber 68B rise, and finally the sewage flows over the first weir portion 62A and the first adjusting weir portion 62D. The overflowing sewage enters the second flowing water channel 80. Here, the above-described filtration screens 70A and 70B are provided at positions other than the position where the third collecting device 88 is placed below the first adjusting weir portion 62D, so that only the sewage passing through the screen bars 78 enters the second flowing water channel 80 at the positions other than the position where the third collecting device 88 is placed below the first adjusting weir portion 62D. Therefore, it is possible to prevent the impurities from falling down to the positions of the second flowing water channel 80 other than the third collecting device 88.

Further, when the flow quantity of the sewage entering the second water diversion chamber 64B increases, the water level of the sewage in the second water diversion chamber 64B rises, and finally the sewage flows over the second weir portion 62B and the second adjusting weir portion 62E. The overflowing sewage enters the second flowing water channel 80. Here, the sewage entering the second water diversion chamber 64B contains no impurities, and therefore the sewage flowing over the second weir portion 62B and the second adjusting weir portion 62E and falling down to the second flowing water channel 80 contains no impurities, thus preventing the impurities from falling down to the positions of the second flowing water channel 80 other than the third collecting device 88.

Further, when the flow quantity of the sewage entering the third water diversion chamber 64C increases, the water level of the sewage in the third water diversion chamber 64C rises, and finally the sewage flows over the third weir portion 62C and the third adjusting weir portion 62F. The overflowing sewage enters the second flowing water channel 80. Here, the sewage entering the third water diversion chamber 64C contains no impurities, and therefore the sewage flowing over the third weir portion 62C and the third adjusting weir portion 62F and falling down to the second flowing water channel 80 contains no impurities, thus preventing the impurities from falling down to the positions of the second flowing water channel 80 other than the third collecting device 88.

Note that the relation between the flow quantity of the sewage passing through each of the orifices 66A and 66*b* and the flow quantity of the sewage flowing over each of the weir portions 62A, 62B and 62C is the same as that in the flowing water splitting apparatus 10 of the first embodiment, and therefore description will be omitted.

As described above, since the most of the sewage flowing from the confluent pipe 54 into the flowing water splitting apparatus main body 52 will enter the rainwater pipe 82 via the second flowing water channel 80, the sewage splitting function of the flowing water splitting apparatus 50 can be enhanced. As a result of this, the flow quantity of the sewage conveyed from the dirty water pipe 56 to the sewage treatment apparatus can be reduced to reduce the facility investment for the sewage treatment apparatus.

As described above, according to the flowing water splitting apparatus 50 of the second embodiment, the impurities contained in the sewage can be removed before the sewage flowing from the confluent pipe 54 to the inside of the flowing water splitting apparatus main body 52 enters the small capacity chamber 68B of the first water diversion chamber 64A, the second water diversion chamber 64B, and the third water diversion chamber 64C. Further, as the method of removing the impurities, the impurities flow toward the main flow direction of the sewage, so that the impurities can be moved on the flow of the sewage to the collecting devices 84, 86 and 88 side. Further, the impurities flow in the main flow direction of the sewage, thus making it possible for the impurities to hardly enter the orifices 66A and 66B side located in the branch direction of the sewage. Further, the second flowing water channel 80 is provided with the collecting devices 84, 86 and 88, thud making it possible to collect the impurities falling down to the second flowing water channel 80 automatically and easily by the collecting devices 84, 86 and 88. As a result of this, the human or mechanical management for collecting the impurities becomes unnecessary.

Here, since the collecting devices having different in size and different in mesh dimension (size) of the bag body are provided to form a triplex structure as the collecting devices 84, 86 and 88, the impurities can be classified for each size by the sizes of the meshes of the collecting devices 84, 86 and 88. Concretely, the impurity with the largest volume is collected by the third collecting device 88 with the largest mesh located innermost, the impurity with the next largest volume is collected by the second collecting device 86 located in the middle, and the impurity with the smallest volume is collected by the first collecting device 84 with the smallest mesh located outermost. In this manner, the impurities can be collected automatically and separately for each size (volume) of the impurities.

Further, since the first water diversion chamber 64A is provided with the filtration screens 70A and 70B, the sewage can pass from the large capacity chamber 68A to the small capacity chamber 68B with the impurities contained in the sewage removed. Therefore, the entry of the impurities to the dirty water pipe 56 passing through the orifices 66A and 66B can be suppressed. Further, since the impurities are never contained in the sewage passing through the filtration screens 70A and 70B and flowing over the weir portions 62A, 62B and 62C and the adjusting weir portions 62D, 62E, and 62F, entry of the impurities into the rainwater pipe 82 can be suppressed.

In particular, as shown in FIG. 18, each of the filtration screens 70A and 70B is composed of the screen vertical outer frame 72, the screen horizontal outer frame 74, and the screen bars 78, so that an impurity removing device capable of removing the impurities by a simple structure can be manufacture.

Next, a sewage system employing the flowing water splitting apparatus of the above-described embodiment of the present invention will be described. Note that the flowing water splitting apparatus 10 of the first embodiment or the flowing water splitting apparatus 50 of the second embodiment can be applied to the flowing water splitting apparatus.

Figure 22:
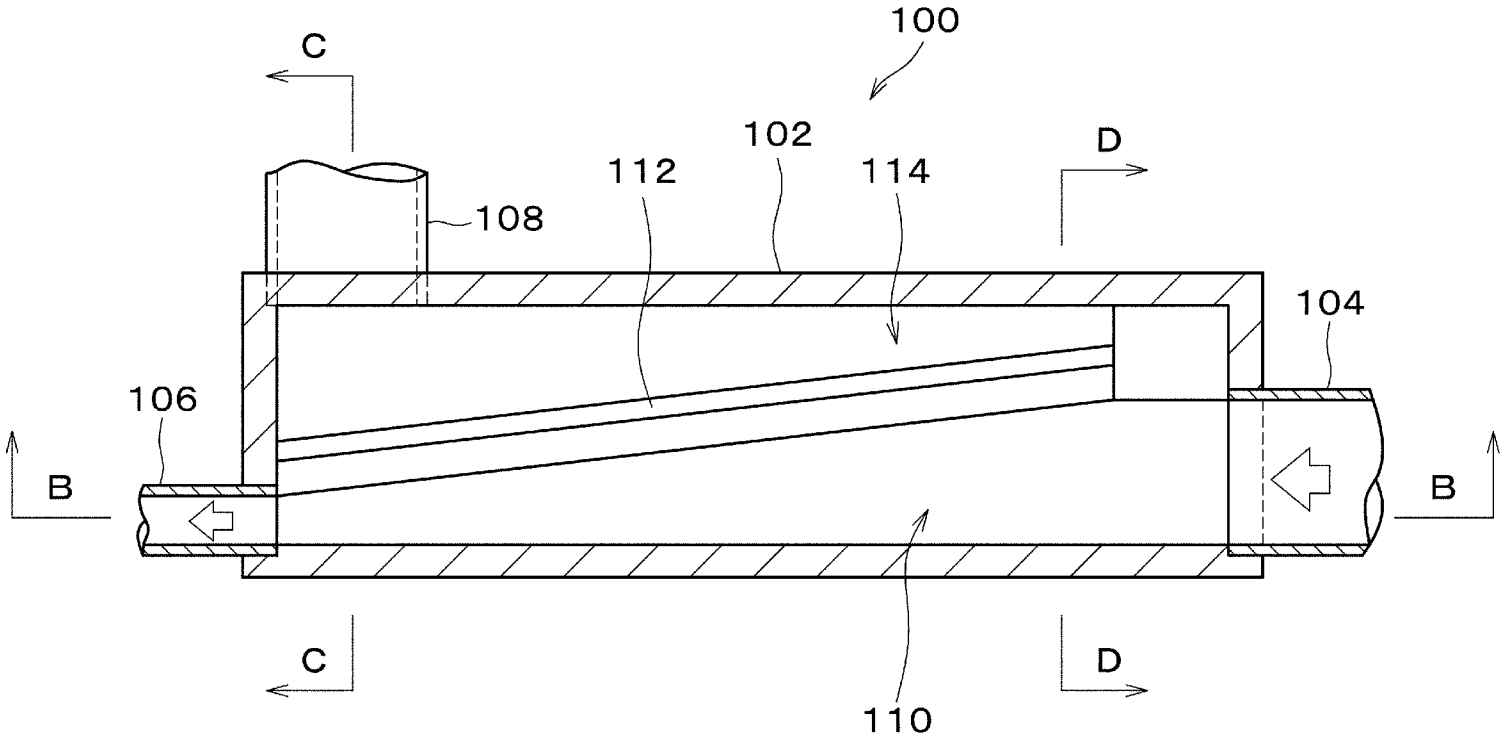
FIG. 22 PRIOR ART
FIG. 22 is a plane sectional view (sectional view taken along A-A in FIG. 23) of a flowing water splitting apparatus in the prior art (in a state in which flowing water in a flow quantity equal to or less than a predetermined quantity flows)
Figure 23:
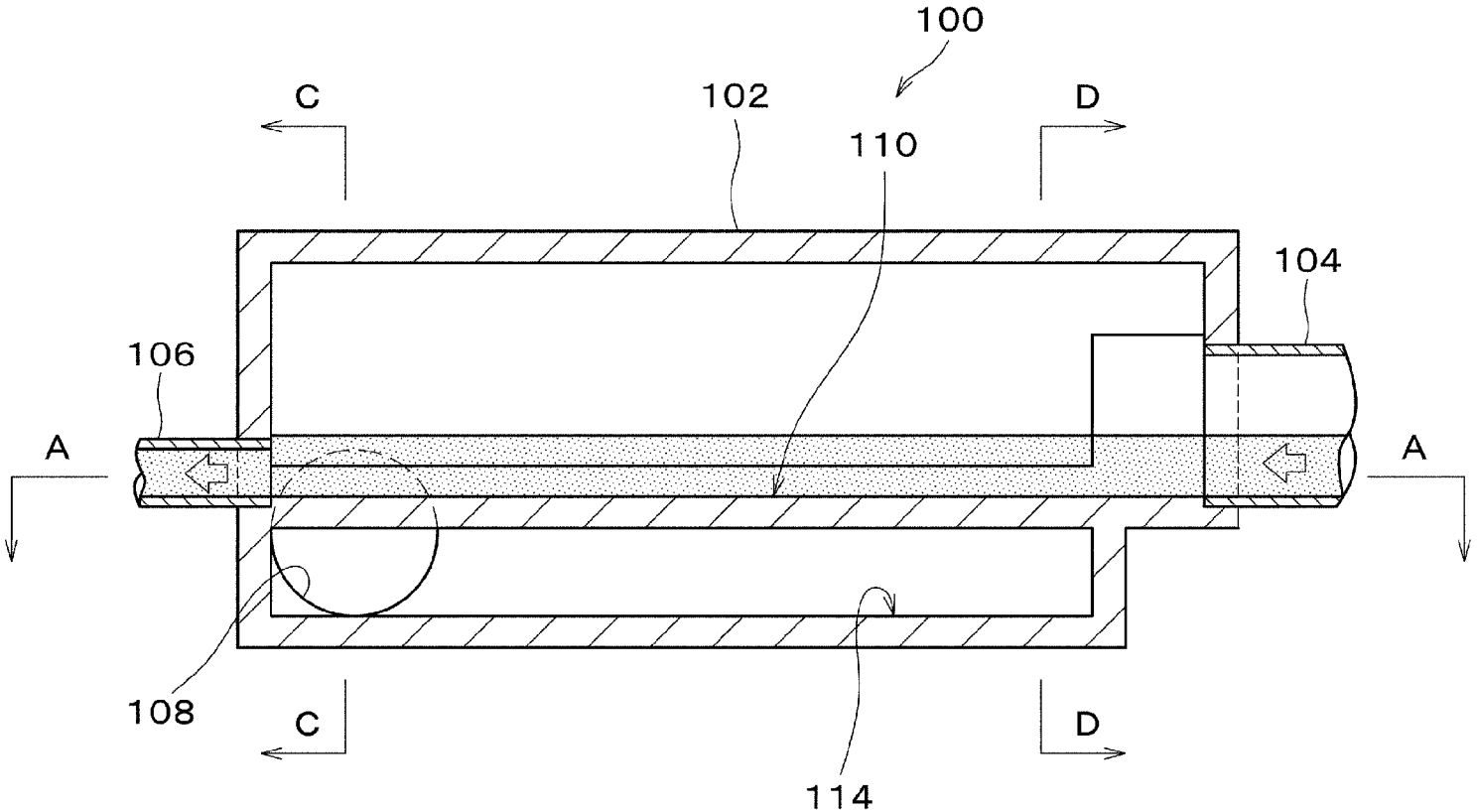
FIG. 23 PRIOR ART
FIG. 23 is a vertical sectional view (sectional view taken along B-B in FIG. 22) of the flowing water splitting apparatus in the prior art (in the state in which flowing water in the flow quantity equal to or less than the predetermined quantity flows)
Figure 24:
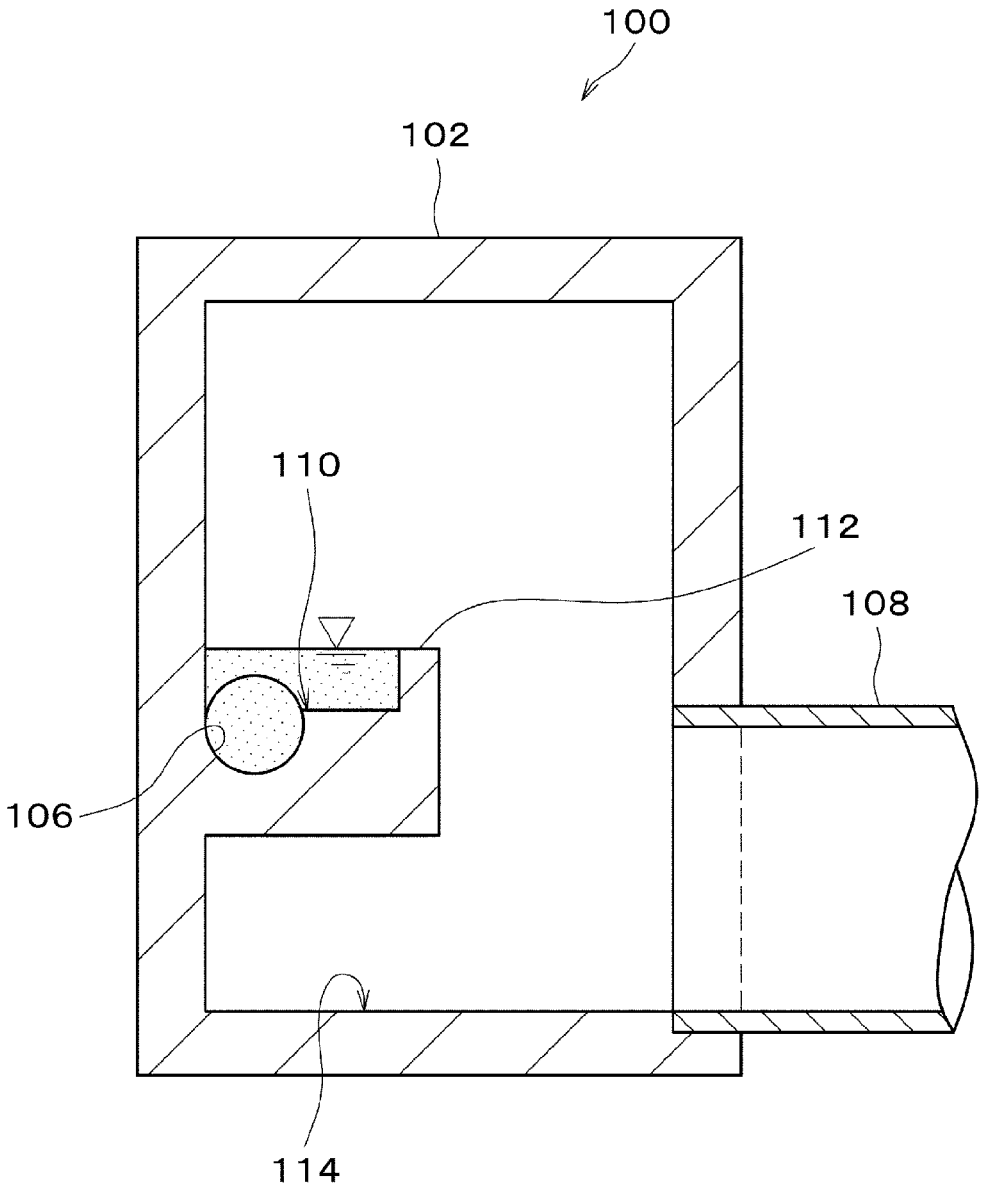
FIG. 24 PRIOR ART
FIG. 24 is a sectional view taken along C-C of the flowing water splitting apparatus in FIG. 22 or FIG. 23 (in the state in which flowing water in the flow quantity equal to or less than the predetermined quantity flows)
Figure 25:
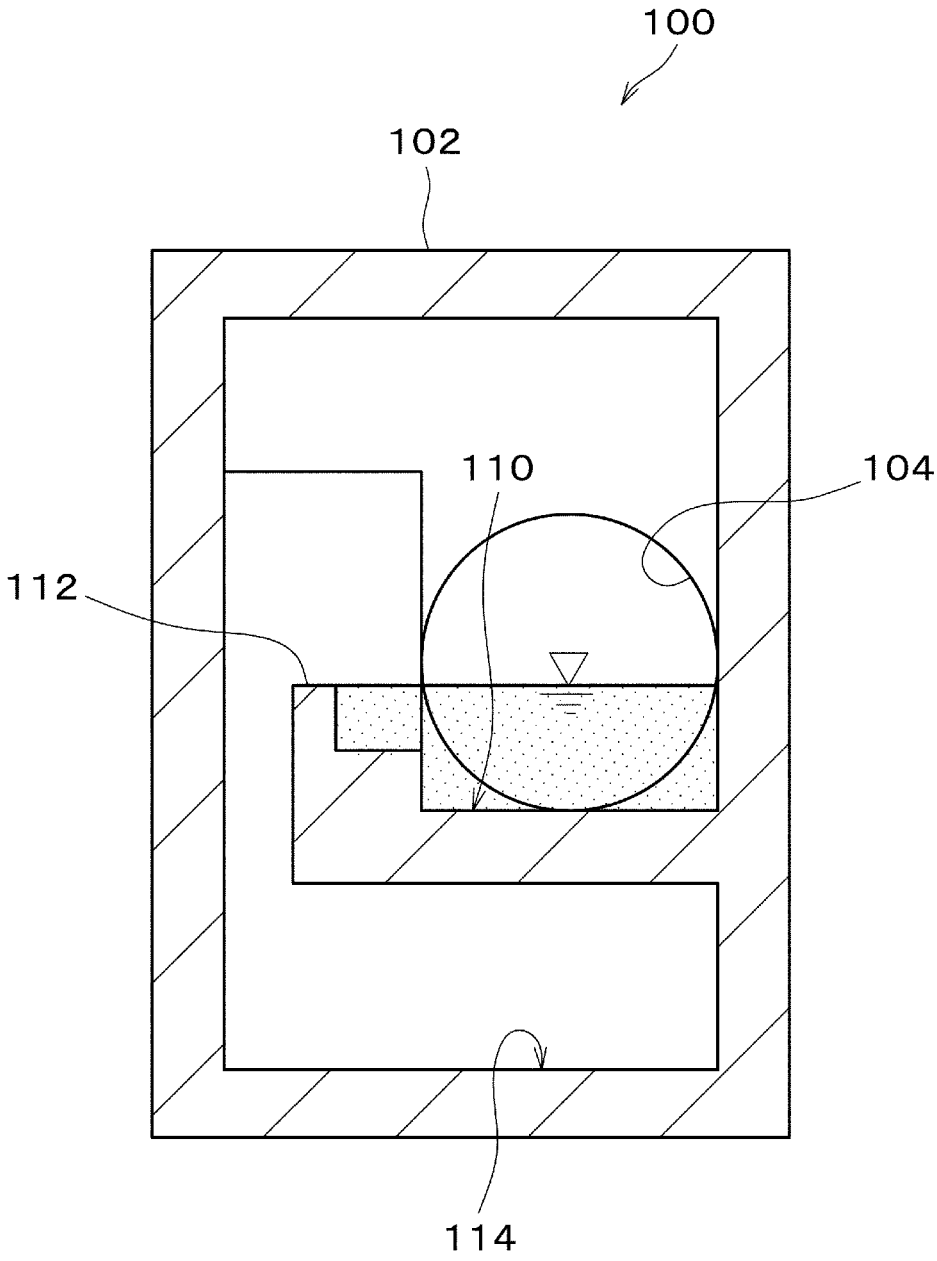
FIG. 25 PRIOR ART
FIG. 25 is a sectional view taken along D-D of the flowing water splitting apparatus in FIG. 22 or FIG. 23 (in the state in which flowing water in the flow quantity equal to or less than the predetermined quantity flows)
Figure 26:
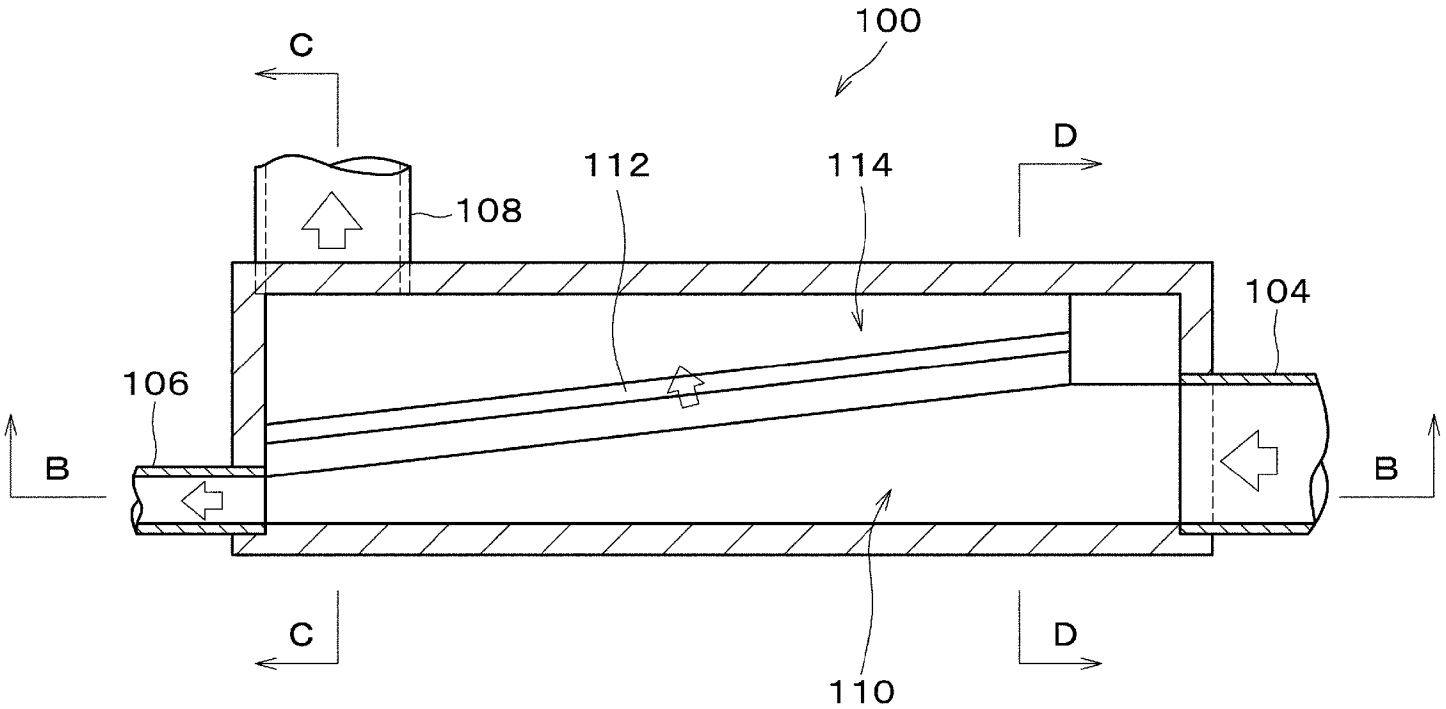
FIG. 26 PRIOR ART
FIG. 26 is a plane sectional view (sectional view taken along A-A in FIG. 27) of the flowing water splitting apparatus in the prior art (in a state in which flowing water in a flow quantity greater than the predetermined quantity flows)
Figure 27:
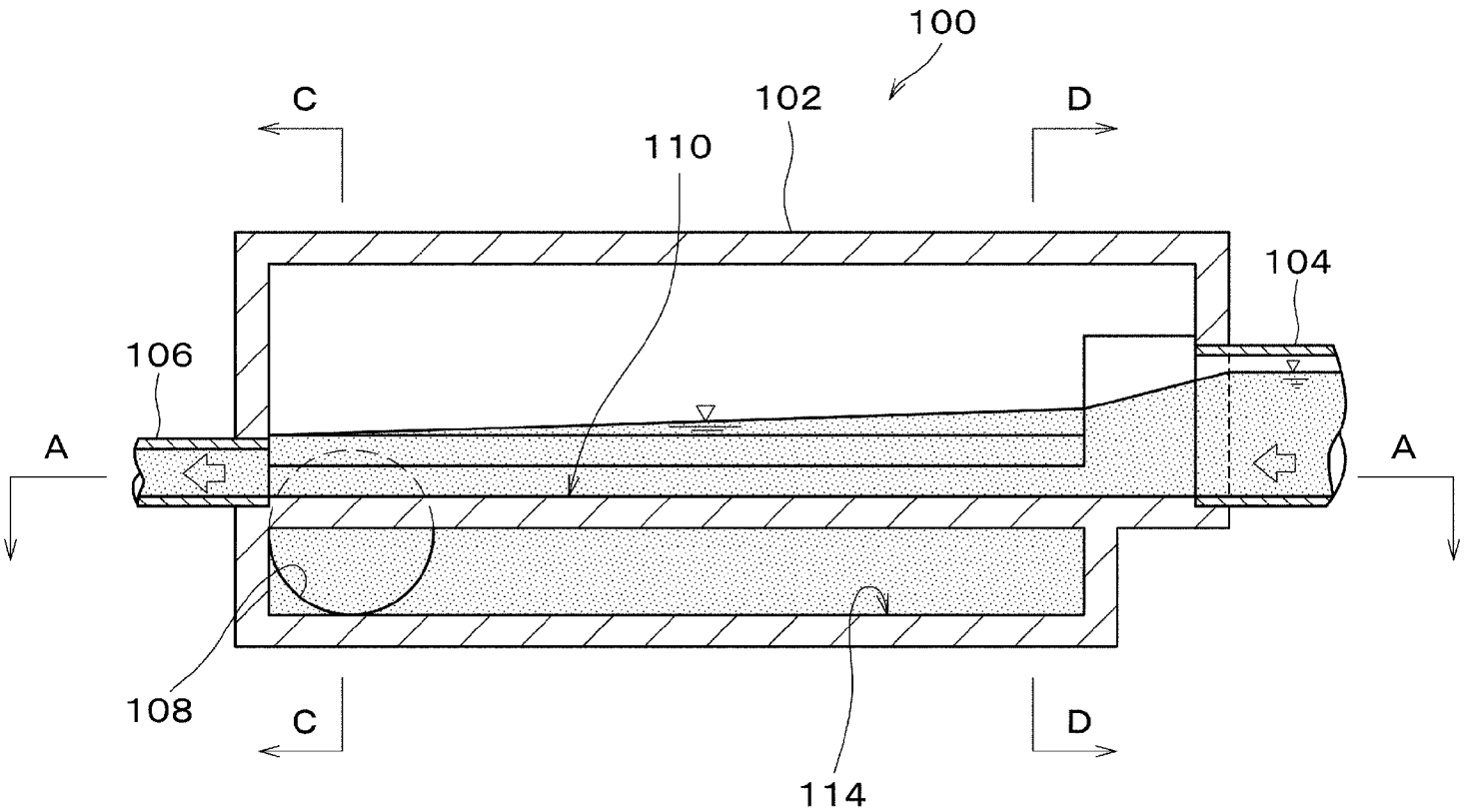
FIG. 27 PRIOR ART
FIG. 27 is a vertical sectional view (sectional view taken along B-B in FIG. 26) of the flowing water splitting apparatus in the prior art (in the state in which flowing water in the flow quantity greater than the predetermined quantity flows)
Figure 28:
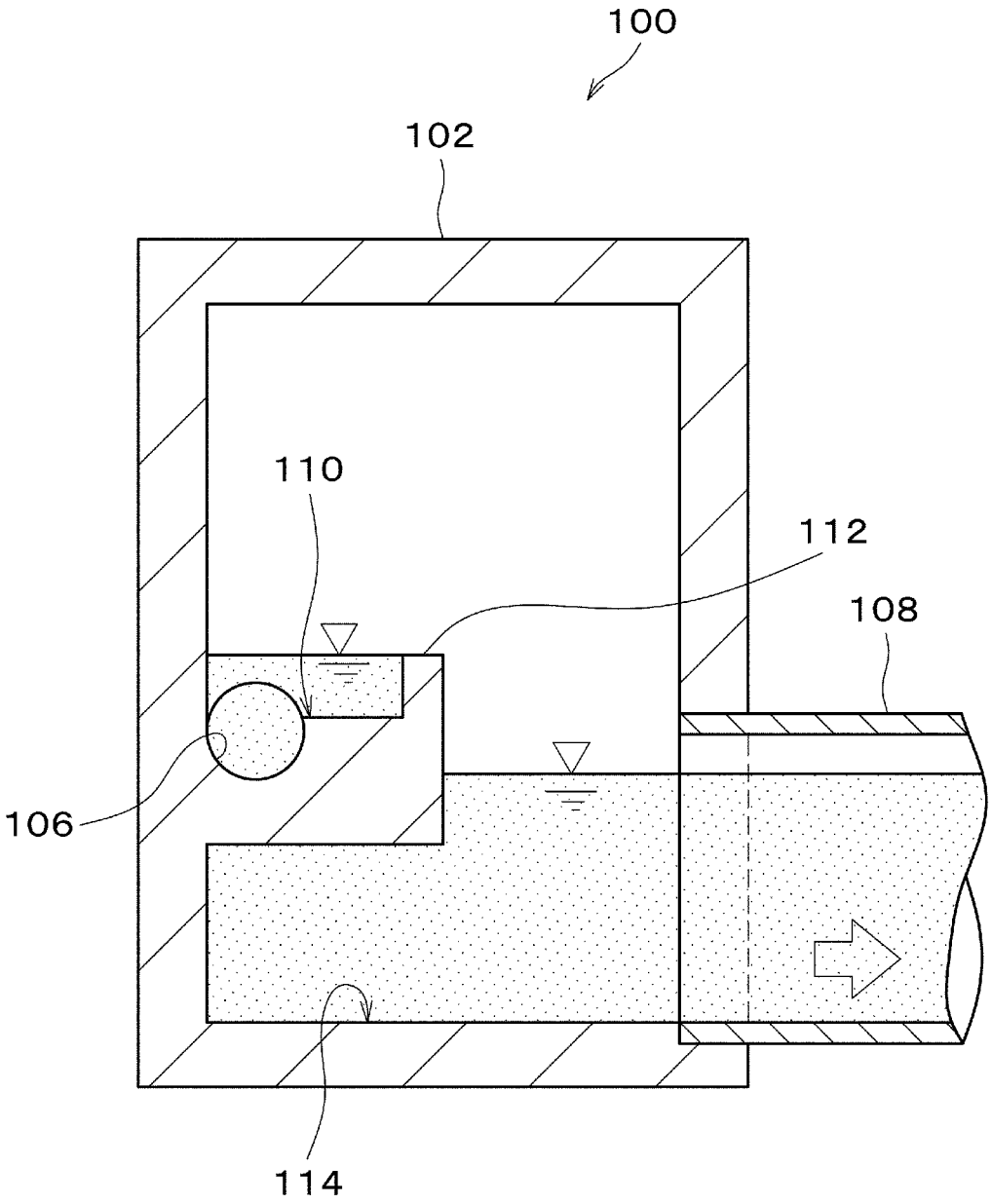
FIG. 28 PRIOR ART
FIG. 28 is a sectional view taken along C-C of the flowing water splitting apparatus in FIG. 26 or FIG. 27 (in the state in which flowing water in the flow quantity greater than the predetermined quantity flows)
Figure 29:
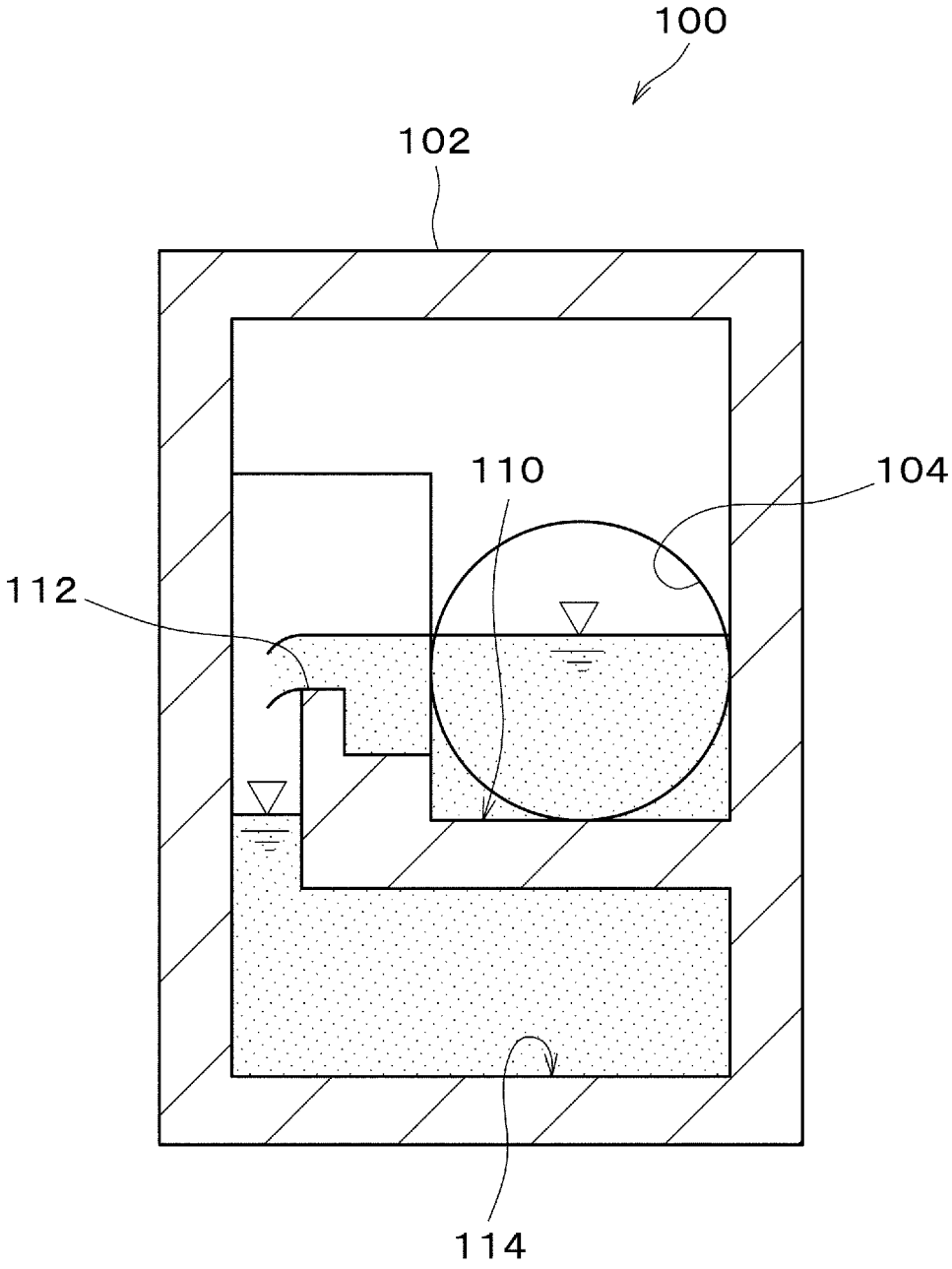
FIG. 29 PRIOR ART
FIG. 29 is a sectional view taken along D-D of the flowing water splitting apparatus in FIG. 26 or FIG. 27 (in the state in which flowing water in the flow quantity greater than the predetermined quantity flows).

First of all, a sewage system employing a rainwater discharge chamber 100 (see FIG. 22 or see FIG. 26) in the prior art will be described as a related art.

Figure 19:
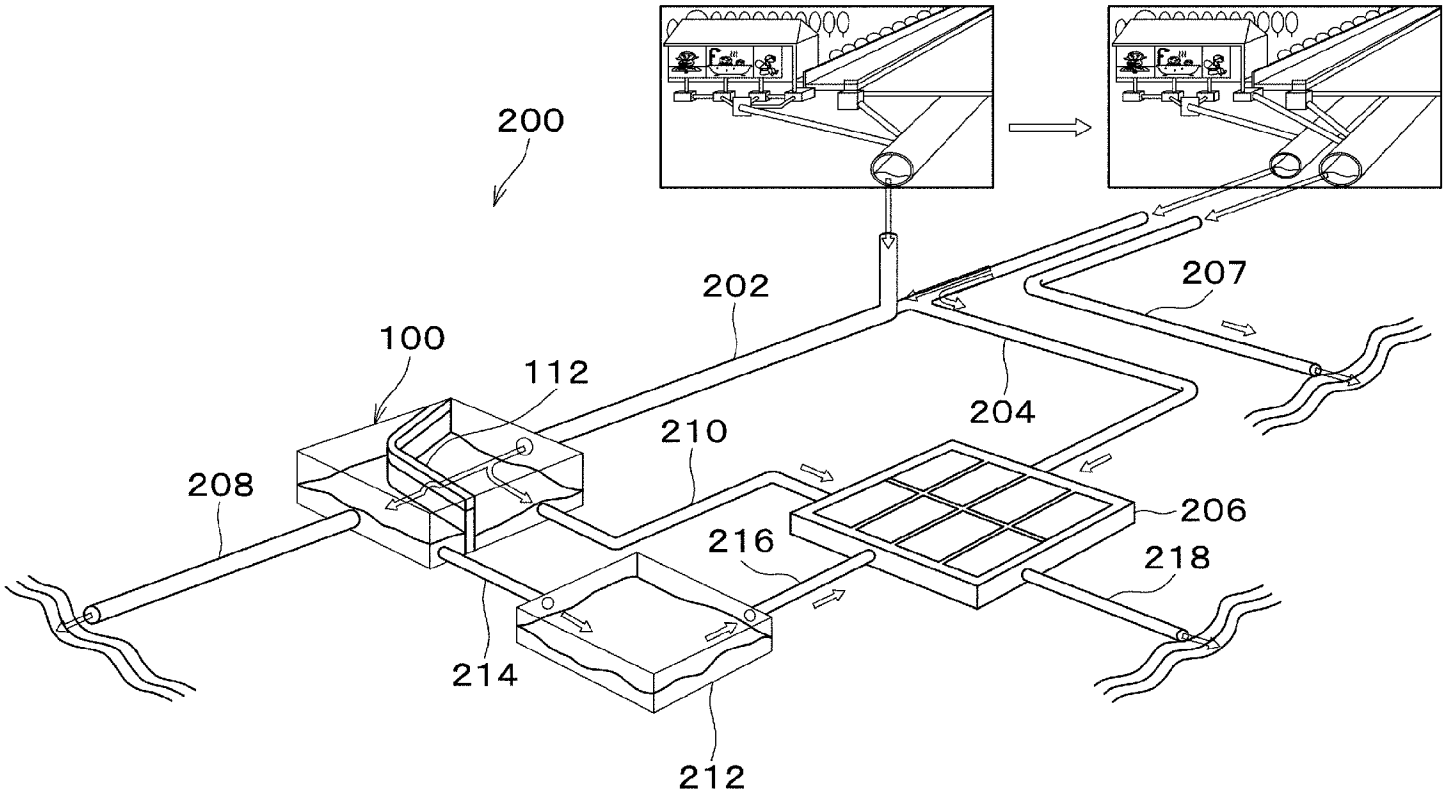
FIG. 19 is a configuration diagram of an existing sewage system employing a conventional rainwater discharge chamber.

As shown in FIG. 19, to the rainwater discharge chamber 100 (see FIG. 22 or see FIG. 26) of a sewage system 200, a sewage pipe 202 is connected. To the sewage pipe 202, sewage in a confluent sewage line in which domestic waste water and rainwater are mixed and sewage in a diffluent sewage line in which domestic waste water and rainwater are separated are supplied. Therefore, the sewage in the confluent sewage line in which domestic waste water and rainwater are mixed and a part of the domestic waste water of the sewage in the diffluent sewage line in which domestic waste water and rainwater are separated which are supplied to the sewage pipe 202 flow into the rainwater discharge chamber 100. Further, the part of the domestic waste water of the sewage in the diffluent sewage line is supplied to a sewage treatment apparatus (purifying center) 206 via a sewage pipe 204. Further, the rainwater of the sewage in the diffluent sewage line is supplied to a river via a sewage pipe 207.

To the rainwater discharge chamber 100, a sewage pipe 208 is connected so that the sewage (domestic waste water and rainwater) flowing over a weir 112 of the rainwater discharge chamber 100 passes through the sewage pipe 208 and flows into a river.

To the rainwater discharge chamber 100, the sewage treatment apparatus 206 is connected via a sewage pipe 210. Sewage not flowing over the weir 112 of the sewage supplied to the inside of the rainwater discharge chamber 100 passes through the sewage pipe 210 and flows into the sewage treatment apparatus 206.

To the rainwater discharge chamber 100, a water storage apparatus 212 for adjusting the flow quantity of the sewage to the sewage treatment apparatus 206 is connected via a sewage pipe 214. At the time of heavy rain, a part of the sewage flowing over the weir 112 of the sewage supplied to the inside of the rainwater discharge chamber 100 passes through the sewage pipe 214 and flows into the water storage apparatus 212.

To the water storage apparatus 212, the sewage treatment apparatus 206 is connected via a sewage pipe 216. The sewage temporarily stored in the water storage apparatus 212 is conveyed to the sewage treatment apparatus 206 via the sewage pipe 216.

The sewage supplied to the sewage treatment apparatus 206 is purified using a sewage purifying apparatus, and flowed to a river via a sewage pipe 218.

According to the sewage system 200 shown in FIG. 19, if the sewage quantity is small, the sewage supplied to the rainwater discharge chamber 100 flows to the sewage treatment apparatus 206 without flowing over the weir 112. Then, the sewage is purified in the sewage treatment apparatus 206 and then flowed to a river. Therefore, there is little or no sewage flowing over the weir 112 of the rainwater discharge chamber 100, so that the water quantity of the sewage flowing to the water storage apparatus is very small.

On the other hand, the water quantity of the sewage increases due to heavy rain, a part of the sewage supplied to the rainwater discharge chamber 100 flows over the weir 112 and passes through the sewage pipe 208 to a river, and passes through the sewage pipe 214 to the water storage apparatus 212. Then, the sewage is temporarily stored in the water storage apparatus 212. However, the most of the sewage supplied to the rainwater discharge chamber 100 does not flow over the weir 112 but is supplied to the sewage treatment apparatus 206 through the sewage pipe 210.

Here, since the conventional rainwater discharge chamber 100 has a low flowing water splitting function, the most of the sewage is supplied to the sewage treatment apparatus 206 even when the sewage quantity increases due to heavy rain. Therefore, it is necessary to increase the size of the sewage treatment apparatus 206 and to enhance its purifying function. This brings about a problem of an increase in construction cost and maintenance cost of the sewage treatment apparatus 206. Note that if the purifying function of the sewage treatment apparatus 206 is set to be low for reduction in cost, sewage that is not sufficiently purified may flow into a river, causing environment deterioration.

Further, since highly contaminated sewage containing deposit such as on a road or in a sewage pipe present at the time of beginning of rainfall temporarily flows into the rainwater discharge chamber 100 in the conventional sewage system 200, the sewage flowing over the weir 112 increases. In this event, a part of the sewage flowing over the weir 112 flows into the water storage apparatus 212 via the sewage pipe 214. As a result of this, the storage water quantity in the water storage apparatus 212 increases, bringing about a necessity to increase the size of the water storage apparatus 212, leading to increased facility cost.

Note that though it is possible to increase the height of the weir 112 to reduce the sewage quantity flowing to the water storage apparatus 212, this setting further increases the sewage quantity flowing to the sewage treatment apparatus 206. As a result of this, it is necessary to increase the size of the facility of the sewage treatment apparatus 206 and improve its function, causing another problem of significant increase in construction cost and maintenance cost. The measures for the above-described problem 1 and problem 2 are contrary to each other, so that it is impossible to solve both problems in the configuration employing the rainwater discharge chamber 100 in the prior art having a low flowing water splitting function. As a result of this, two problems, that is, an increase in facility cost of the sewage treatment apparatus 206 or an increase in facility cost of the water storage apparatus 212 and generation of environment contamination of a river, always occur.

Here, in place of the above-described rainwater discharge chamber 100 of the sewage system 200, a sewage system employing the flowing water splitting apparatus 10 or 50 (see FIG. 1 and FIG. 15) of the first embodiment or the second embodiment of the present invention will be discussed as a comparison example. Note that the same code as those of the configurations in FIG. 19 are given to the configurations in FIG. 20 overlapping the configurations in FIG. 19.

Figure 15:
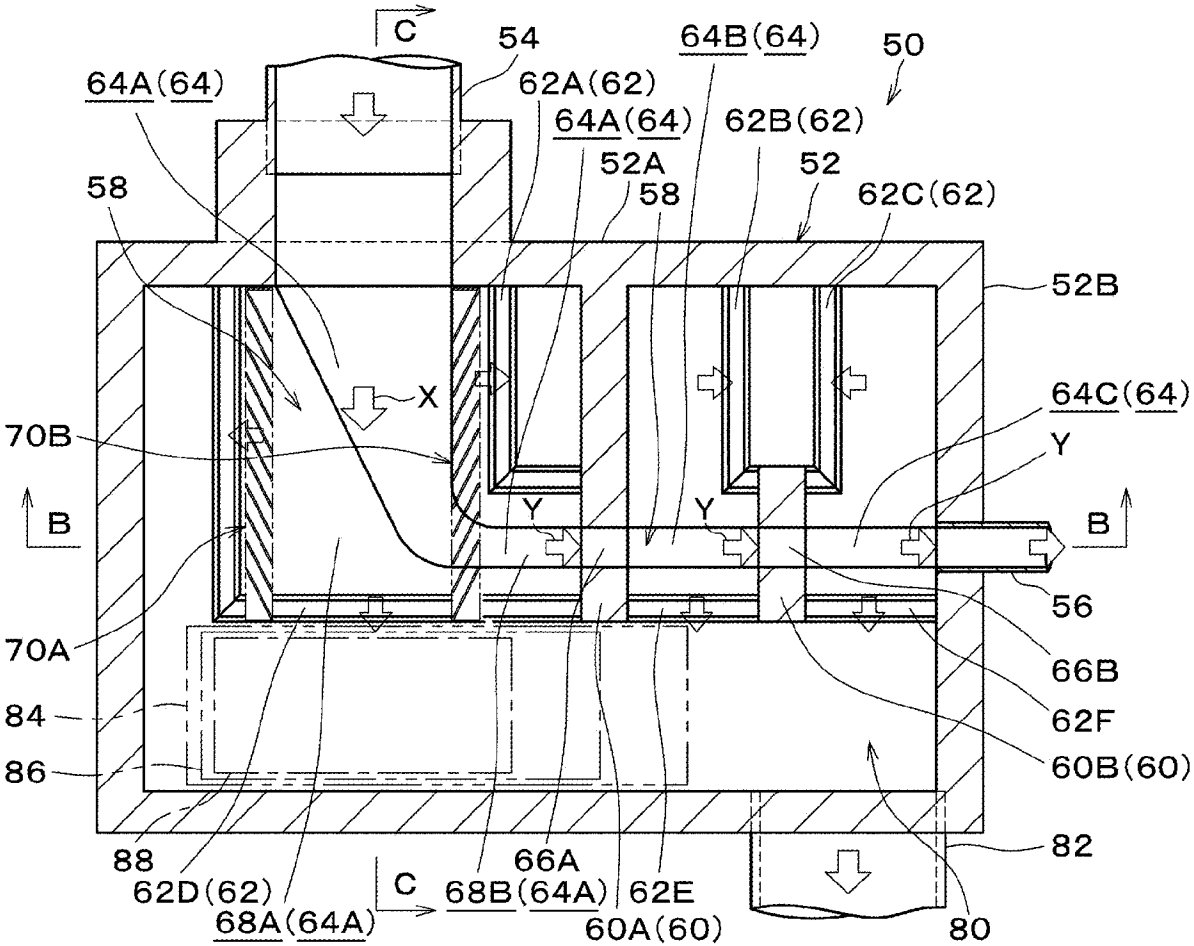
FIG. 15 is a plane sectional view (sectional view taken along A-A in FIG. 16) of a flowing water splitting apparatus according to a second embodiment of the present invention.
Figure 20:
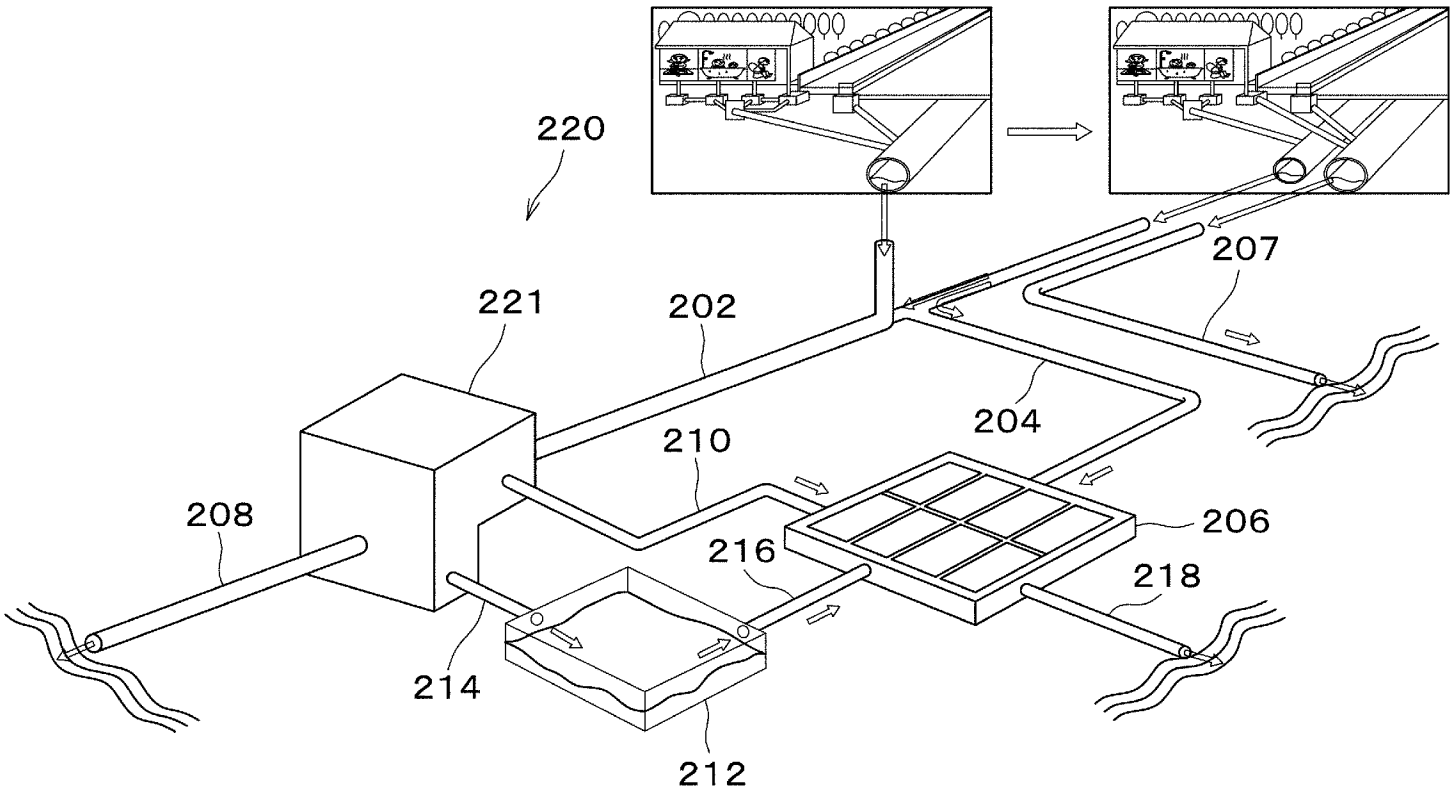
FIG. 20 is a configuration diagram of a sewage system (comparison example) employing the flowing water splitting apparatus of the embodiment of the present invention.

As shown in FIG. 20, to a flowing water splitting apparatus 221 of a sewage system 220 in the comparison example, a sewage pipe 202 is connected. To the sewage pipe 202, sewage in a confluent sewage line in which domestic waste water and rainwater are mixed and sewage in a diffluent sewage line in which domestic waste water and rainwater are separated are supplied. The sewage in the confluent sewage line in which domestic waste water and rainwater are mixed and a part of the domestic waste water of the sewage in the diffluent sewage line in which domestic waste water and rainwater are separated which are supplied to the sewage pipe 202 flow to the inside of the flowing water splitting apparatus 221. Further, the part of the domestic waste water of the sewage in the diffluent sewage line is supplied to the sewage treatment apparatus 206 via a sewage pipe 204. Further, the rainwater of the sewage in the diffluent sewage line is supplied to a river via a sewage pipe 207. Note that the flowing water splitting apparatus 10 or 50 shown in FIG. 1 or FIG. 15 is used for the flowing water splitting apparatus 221.

Note that a sewage pipe 210 corresponds to the dirty water pipe 16 (56) (see FIG. 2 or FIG. 16) leading to the sewage treatment apparatus 206, the sewage pipe 202 corresponds to the confluent pipe 14 (54) (see FIG. 2 or FIG. 16), and a sewage pipe 208 corresponds to the rainwater pipe 18 (82) (see FIG. 2 or FIG. 16) for flowing the sewage to a river. Further, at the flowing water splitting apparatus 221, a sewage pipe 214 is newly provided for leading the sewage flowing over the weir portions 24A to 24C (62A to 62C) to a water storage apparatus 212.

According to the sewage system 220 that is the comparison example, the splitting function of the flowing water splitting apparatus 221 is increased, so that a greater quantity of the sewage than that in the rainwater discharge chamber 100 in the prior art flows over the weir portions 24A to 24C (62A to 62C). Therefore, the water quantity of the sewage supplied from the sewage pipe 210 to the sewage treatment apparatus 206 is significantly reduced. Thus, even in the case of a heavy rain, the water quantity of the sewage supplied to the sewage treatment apparatus 206 can be reduced to reduce the size of the sewage treatment apparatus 206, and it becomes unnecessary to enhance its purifying function. As a result of this, the construction cost and the maintenance cost of the sewage treatment apparatus 206 can be significantly reduced. For this reason, the problem 1 occurring in the sewage system using the rainwater discharge chamber 100 in the prior art can be solved.

On the other hand, according to the sewage system 220 that is the comparison example, the water quantity of the sewage flowing over the weir portions 24A to 24C (62A to 62C) of the flowing water splitting apparatus 221 increases, so that the water quantity of the sewage flowing to a river through the sewage pipe 208 and the water quantity of the sewage supplied to the water storage apparatus 212 through the sewage pipe 214 increase. In this case, it becomes necessary to increase the size of the water storage apparatus 212 in order to increase the water storage quantity in the water storage apparatus 212, resulting in increased facility cost. Therefore, the problem 2 occurring in the sewage system using the rainwater discharge chamber 100 in the prior art cannot be solved.

Hence, a new sewage system employing the flowing water splitting apparatus 10 or 50 (see FIG. 1 or FIG. 15) of the first embodiment or the second embodiment of the present invention will be described.

Figure 21:
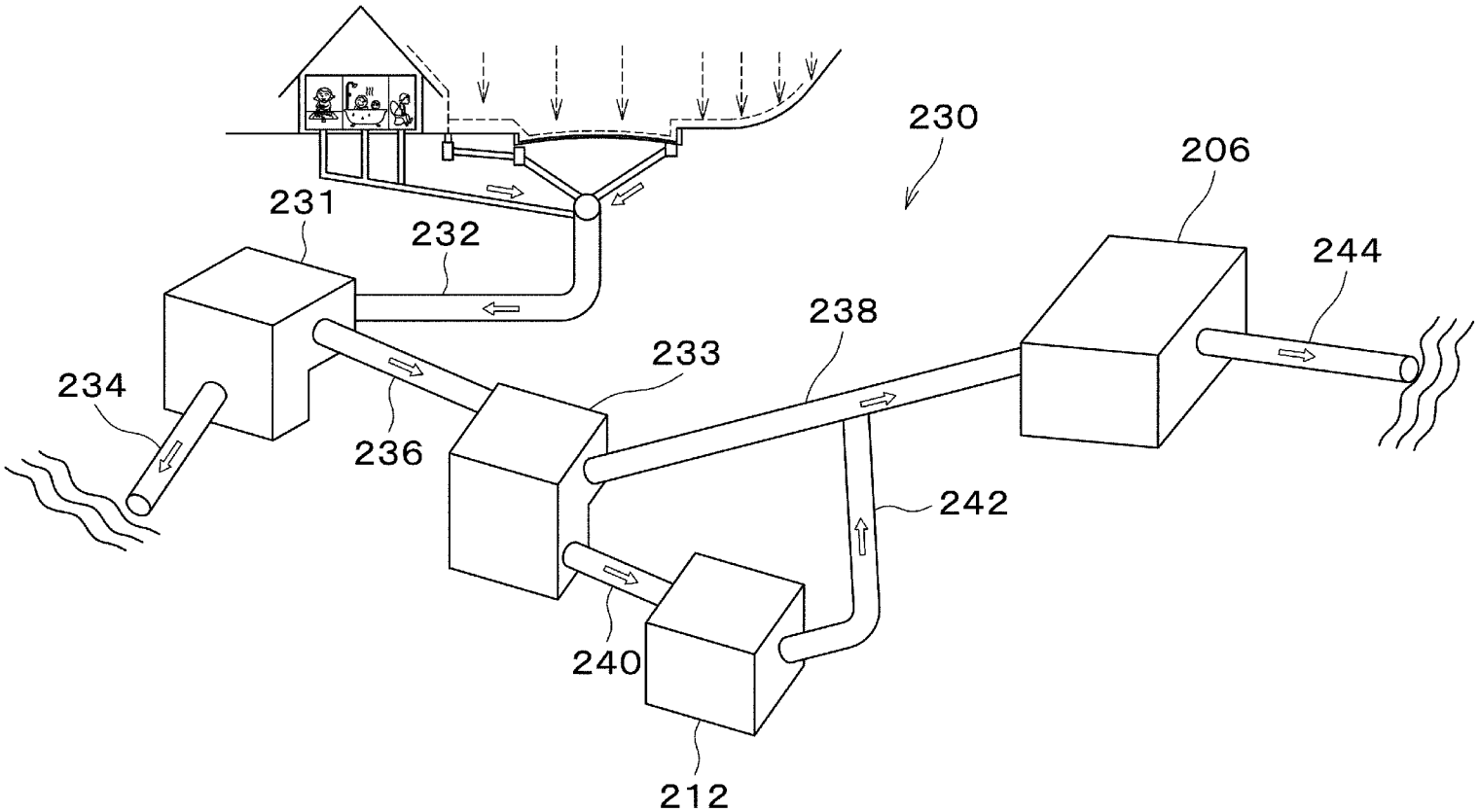
FIG. 21 is a configuration diagram of a sewage system (best mode) employing the flowing water splitting apparatus of the embodiment of the present invention.

As shown in FIG. 21, to a first flowing water splitting apparatus 231 of a sewage system 230 in the best mode, a sewage pipe 232 (confluent pipe) is connected. To the sewage pipe 232, sewage in the confluent sewage line in which domestic waste water and rainwater are mixed is supplied. Therefore, the sewage in the confluent sewage line in which domestic waste water and rainwater are mixed supplied to the sewage pipe 232 flows to the inside of the first flowing water splitting apparatus 231. Further, to the first flowing water splitting apparatus 231, a sewage pipe 234 is connected which leads the sewage flowing over the weir portions 24A to 24C (62A to 62C) (see FIG. 1 and FIG. 15) to a river.

Figure 2:
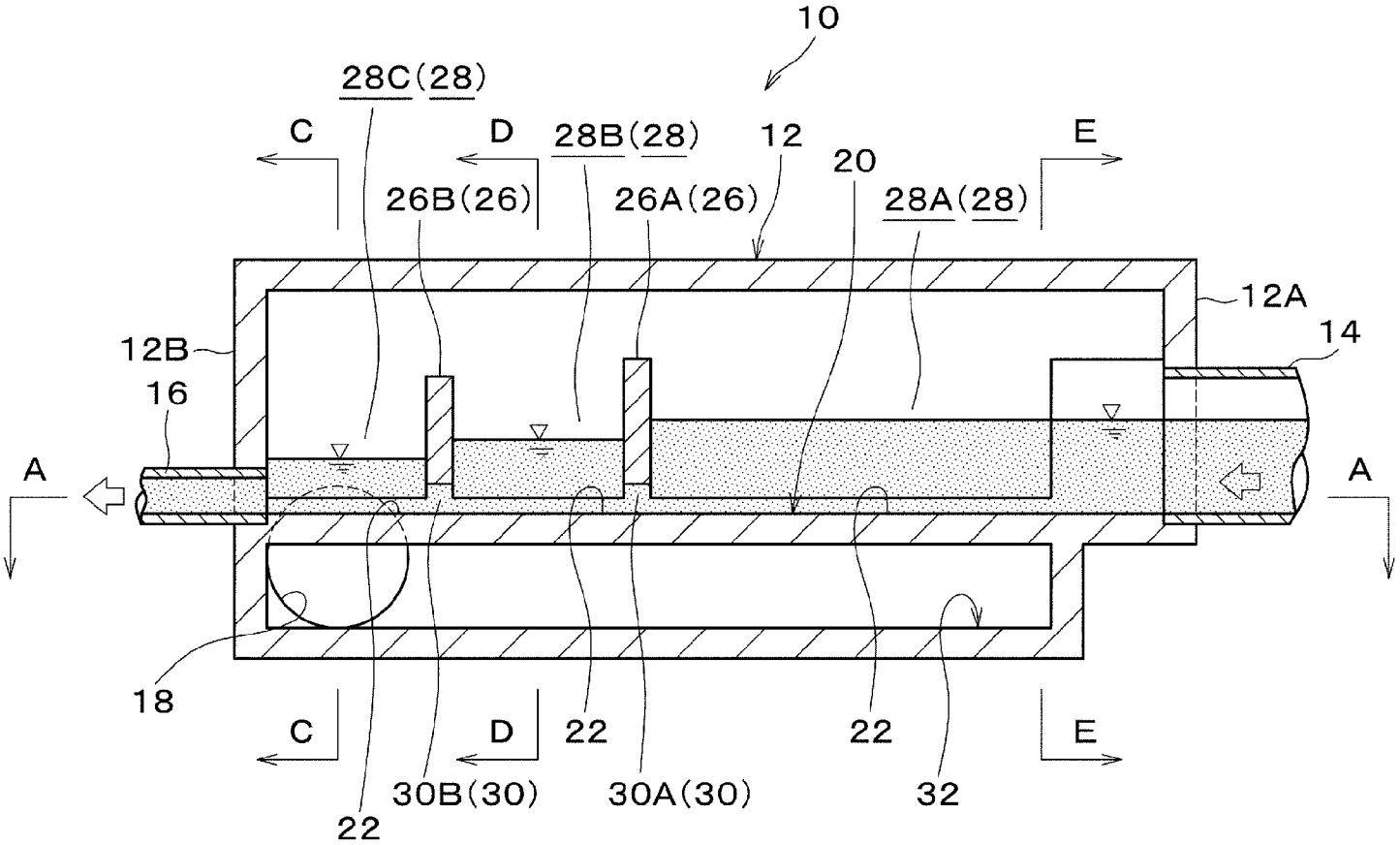
FIG. 2 is a vertical sectional view (sectional view taken along B-B in FIG. 1) of the flowing water splitting apparatus according to the first embodiment of the present invention (in the state in which flowing water in the flow quantity equal to or less than the predetermined quantity flows)
Figure 3:
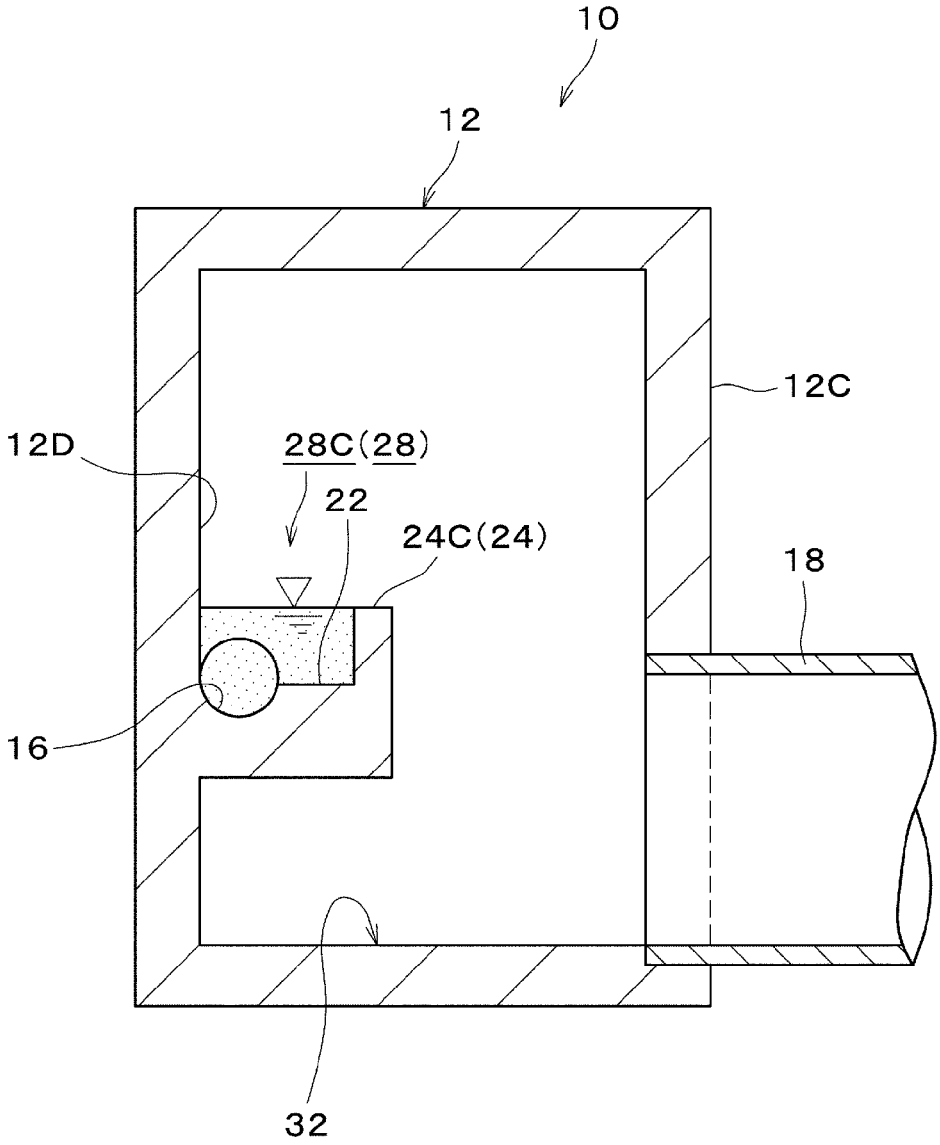
FIG. 3 is a sectional view taken along C-C of the flowing water splitting apparatus in FIG. 1 or FIG. 2 (in the state in which flowing water in the flow quantity equal to or less than the predetermined quantity flows)
Figure 4:
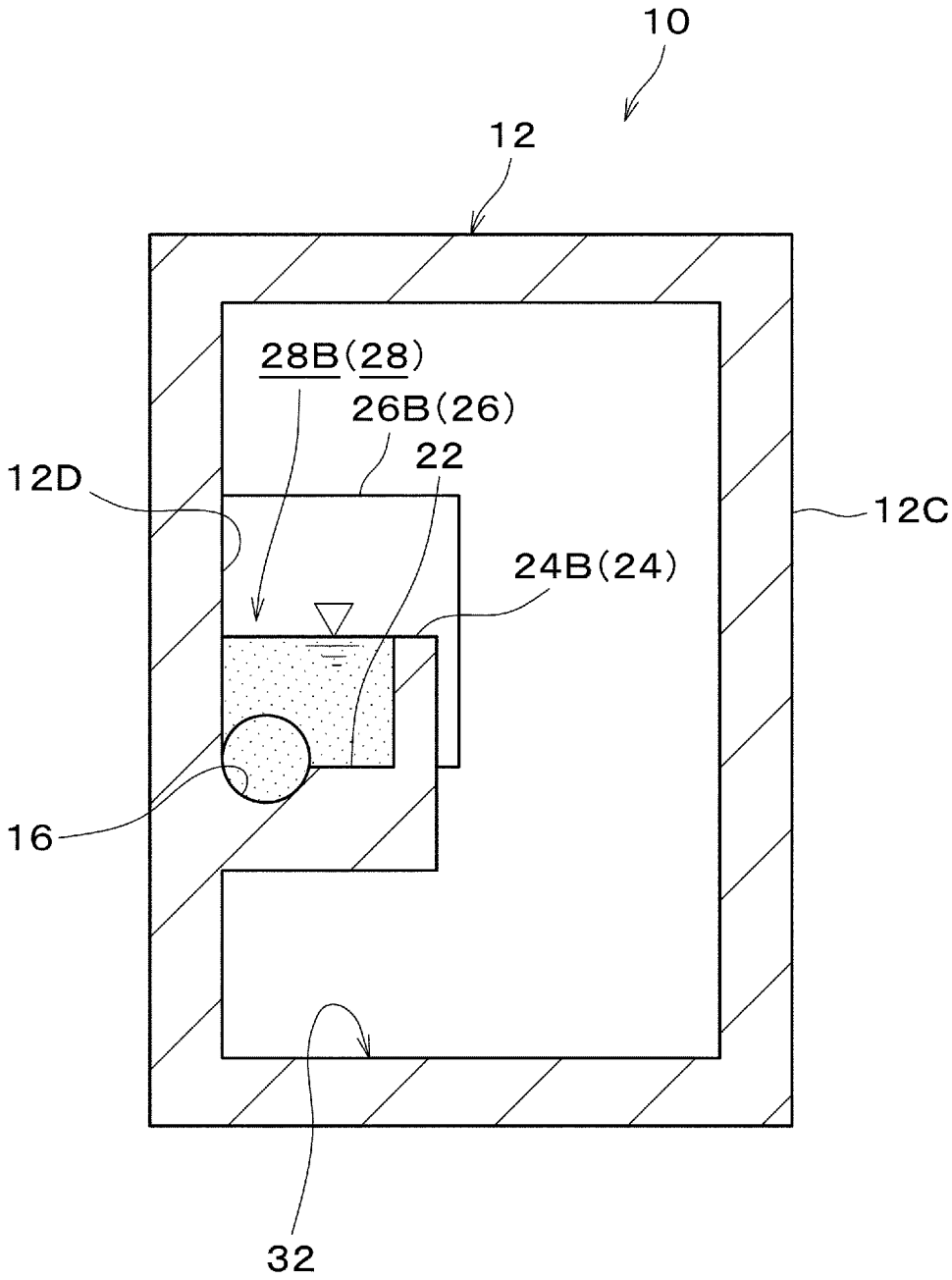
FIG. 4 is a sectional view taken along D-D of the flowing water splitting apparatus in FIG. 1 or FIG. 2 (in the state in which flowing water in the flow quantity equal to or less than the predetermined quantity flows)
Figure 5:
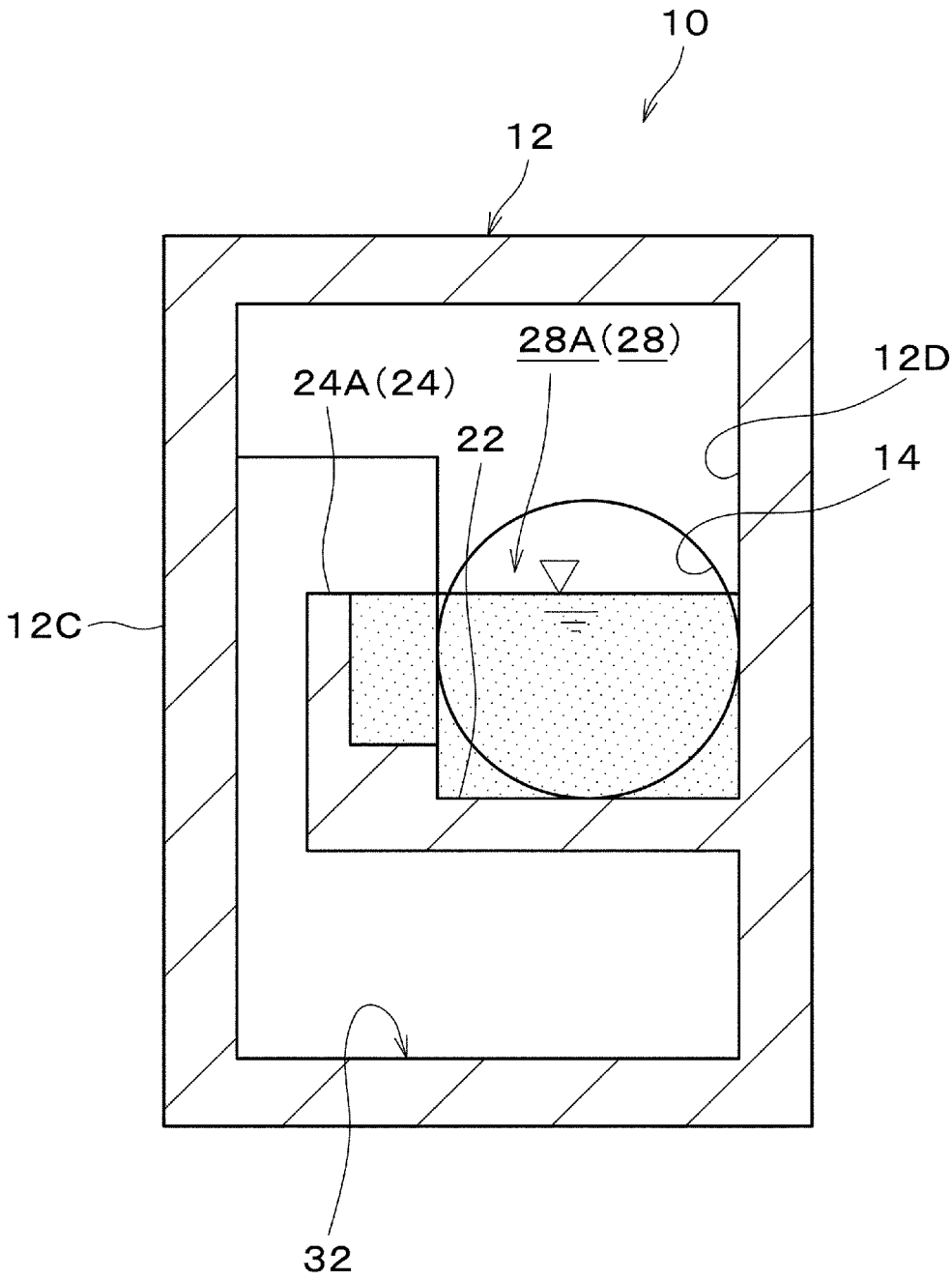
FIG. 5 is a sectional view taken along E-E of the flowing water splitting apparatus in FIG. 1 or FIG. 2 (in the state in which flowing water in the flow quantity equal to or less than the predetermined quantity flows)
Figure 6:
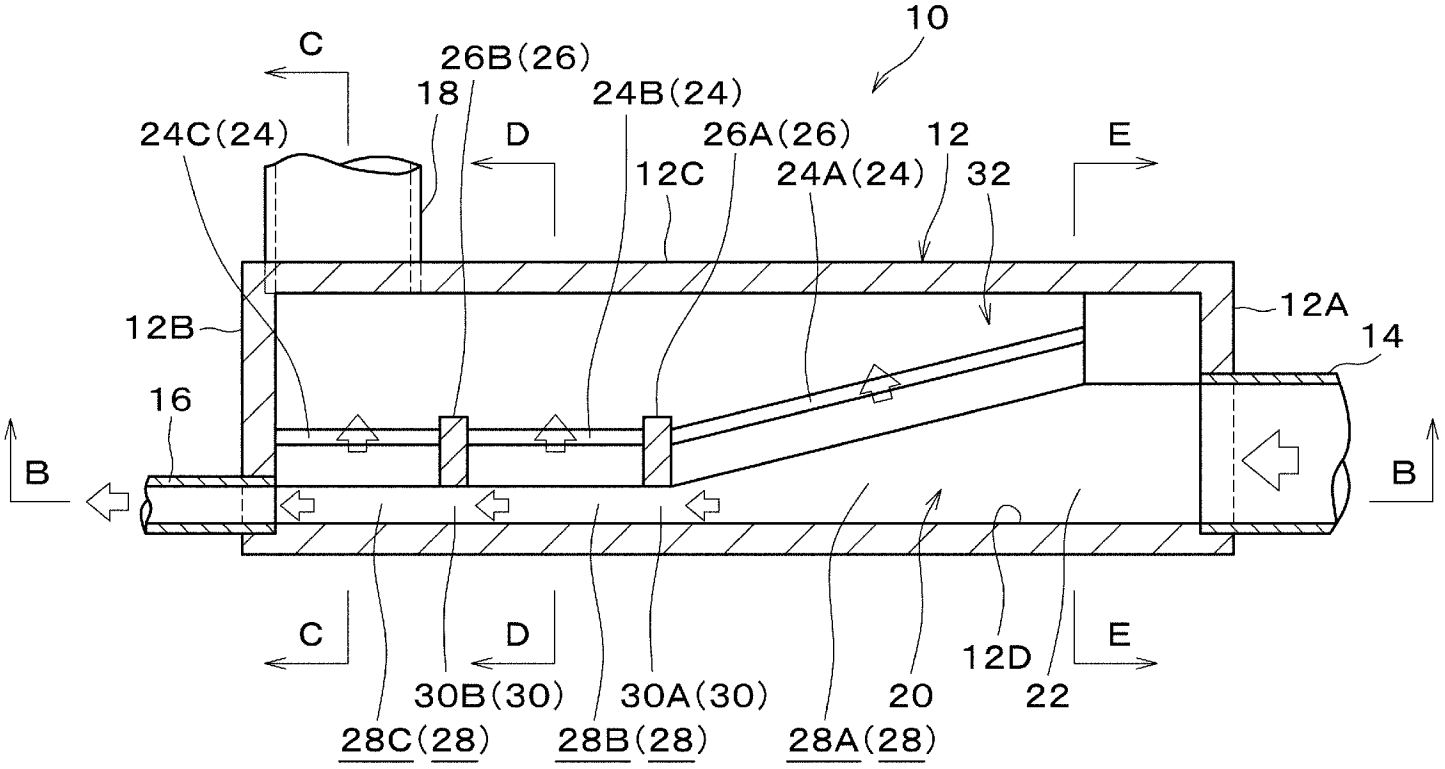
FIG. 6 is a plane sectional view (sectional view taken along A-A in FIG. 7) of the flowing water splitting apparatus according to the first embodiment of the present invention (in a state in which flowing water in a flow quantity greater than the predetermined quantity flows)
Figure 7:
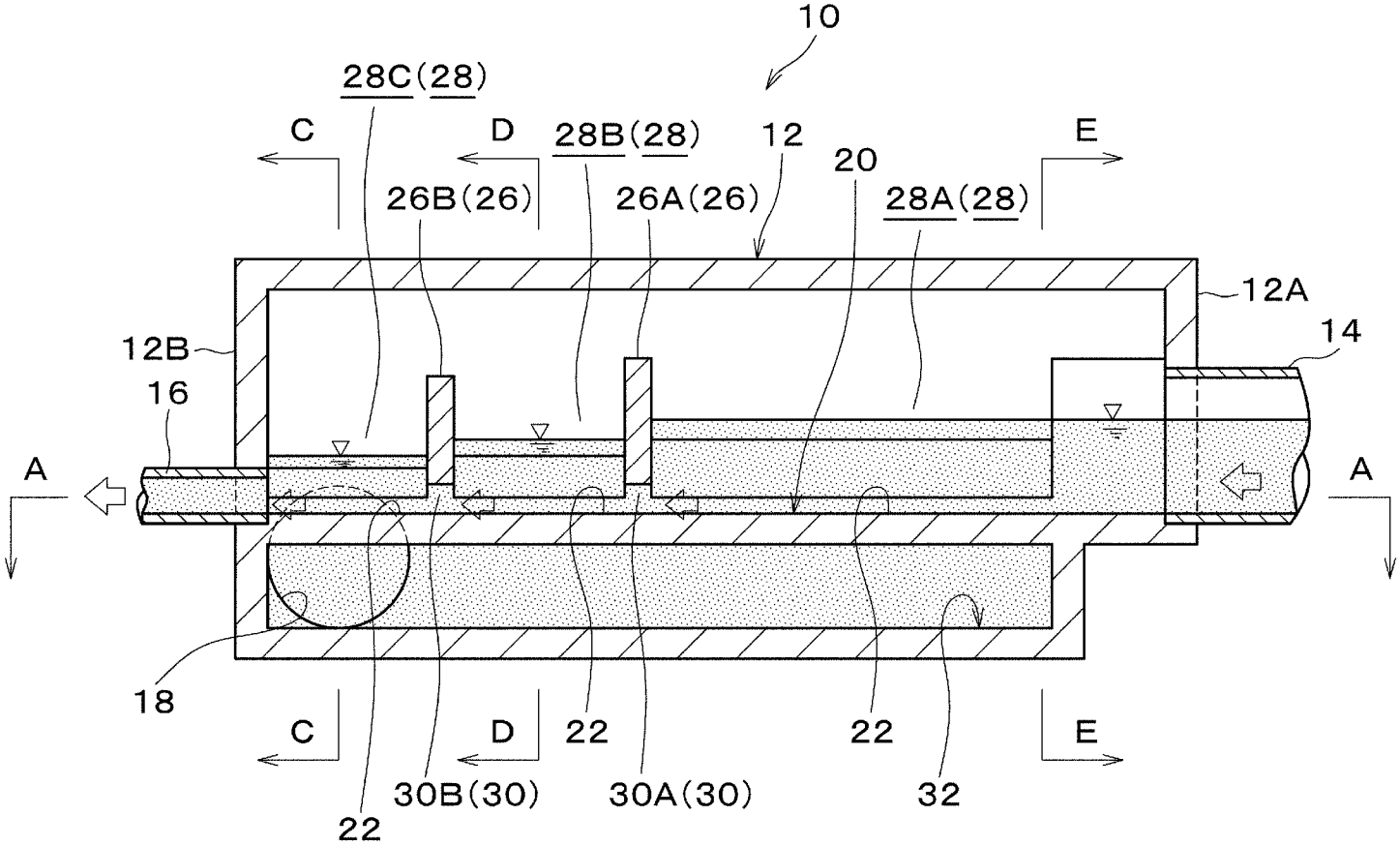
FIG. 7 is a vertical sectional view (sectional view taken along B-B in FIG. 6) of the flowing water splitting apparatus according to the first embodiment of the present invention (in the state in which flowing water in the flow quantity greater than the predetermined quantity flows)
Figure 8:
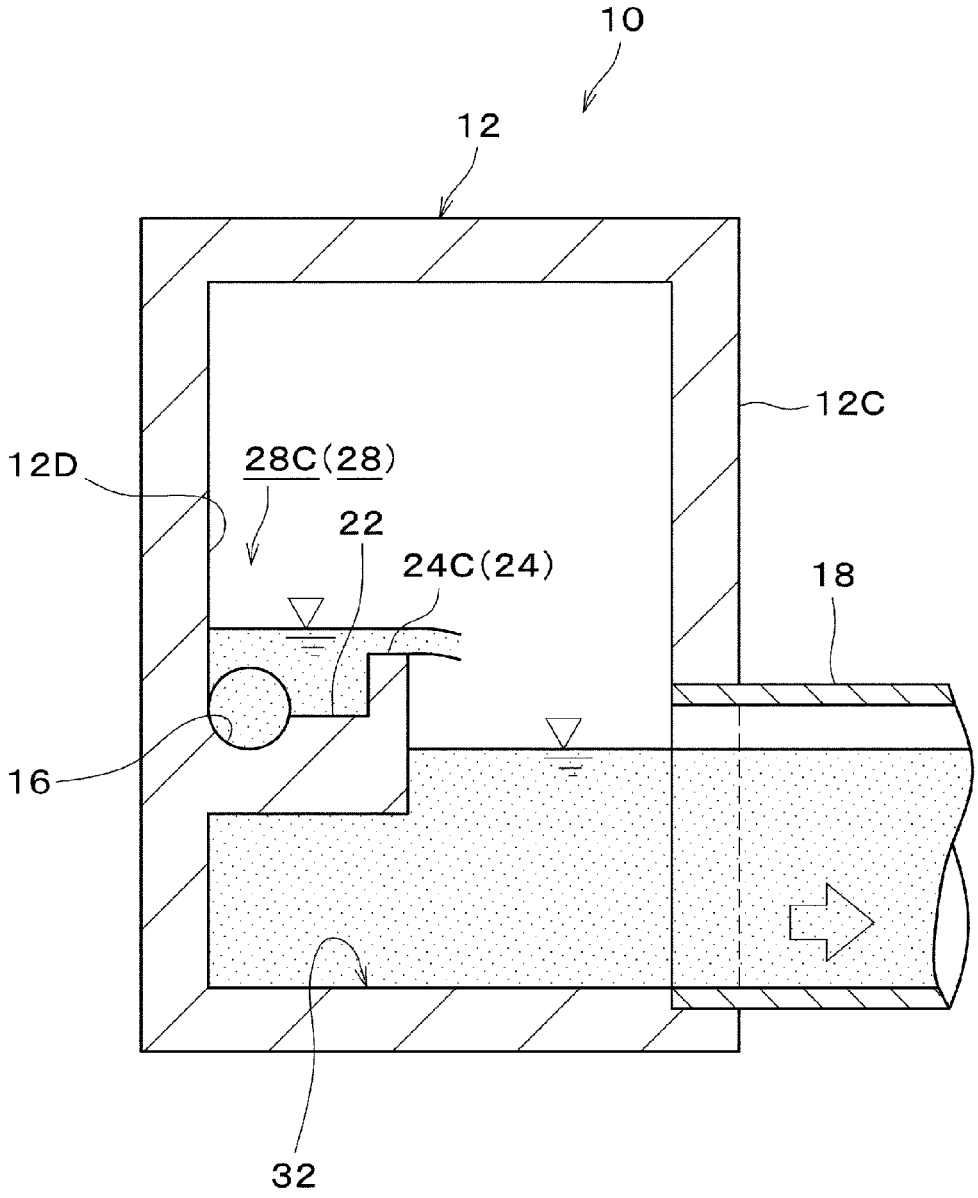
FIG. 8 is a sectional view taken along C-C of the flowing water splitting apparatus in FIG. 6 or FIG. 7 (in the state in which flowing water in the flow quantity greater than the predetermined quantity flows)
Figure 9:
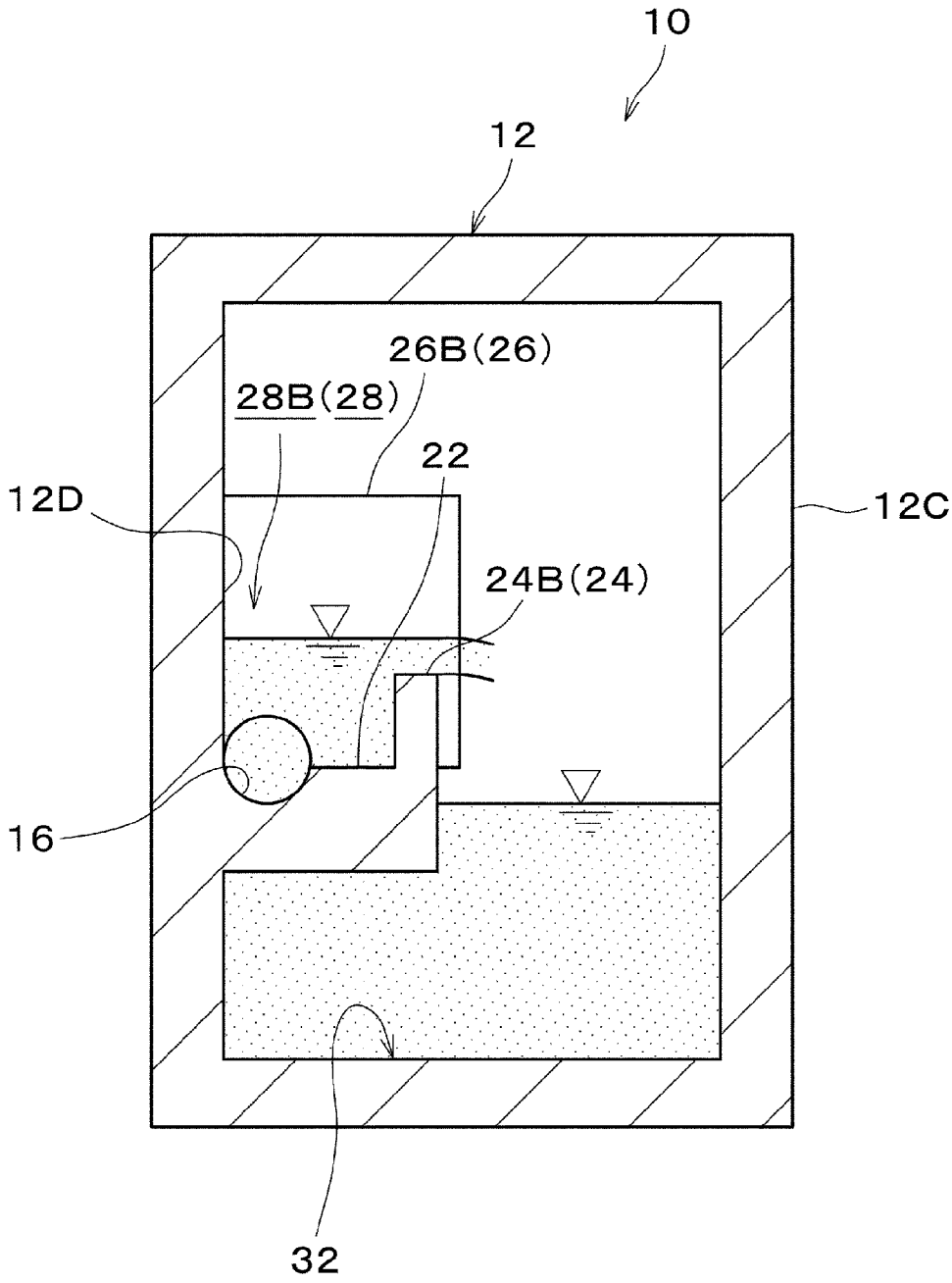
FIG. 9 is a sectional view taken along D-D of the flowing water splitting apparatus in FIG. 6 or FIG. 7 (in the state in which flowing water in the flow quantity greater than the predetermined quantity flows)
Figure 10:
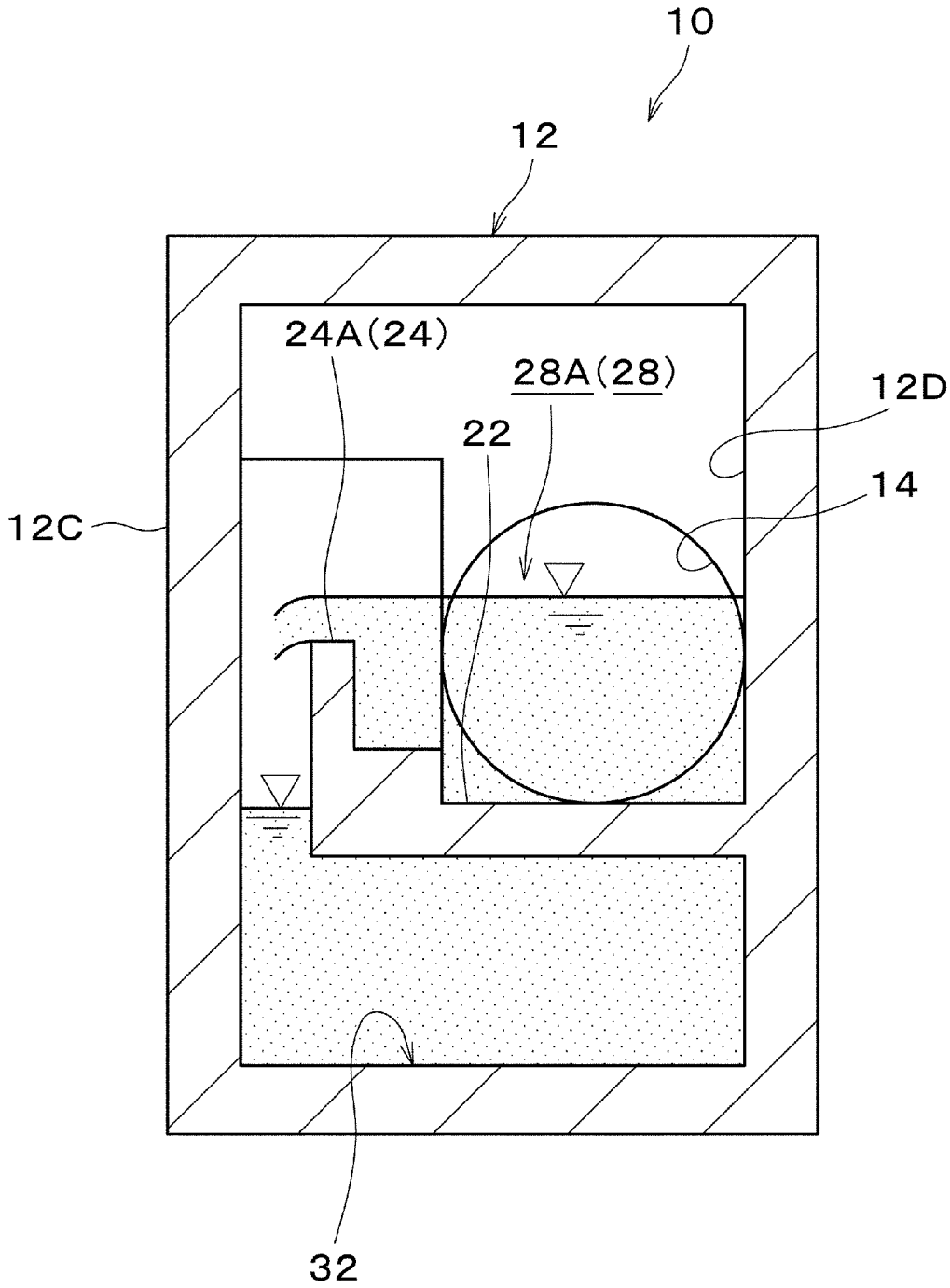
FIG. 10 is a sectional view taken along E-E of the flowing water splitting apparatus in FIG. 6 or FIG. 7 (in the state in which flowing water in the flow quantity greater than the predetermined quantity flows)
Figure 16:
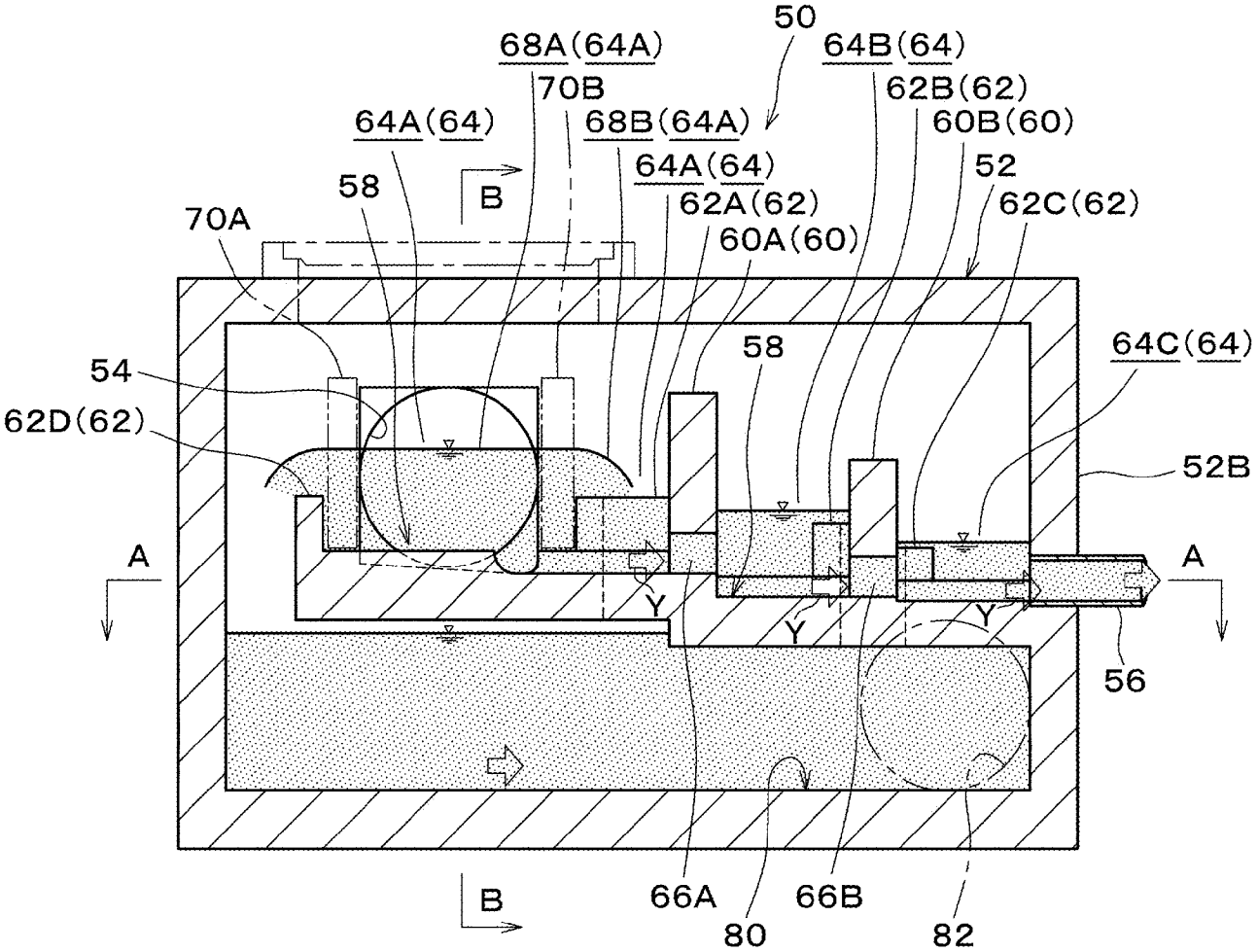
FIG. 16 is a vertical sectional view (sectional view taken along B-B in FIG. 15) of the flowing water splitting apparatus according to the second embodiment of the present invention.
Figure 17:
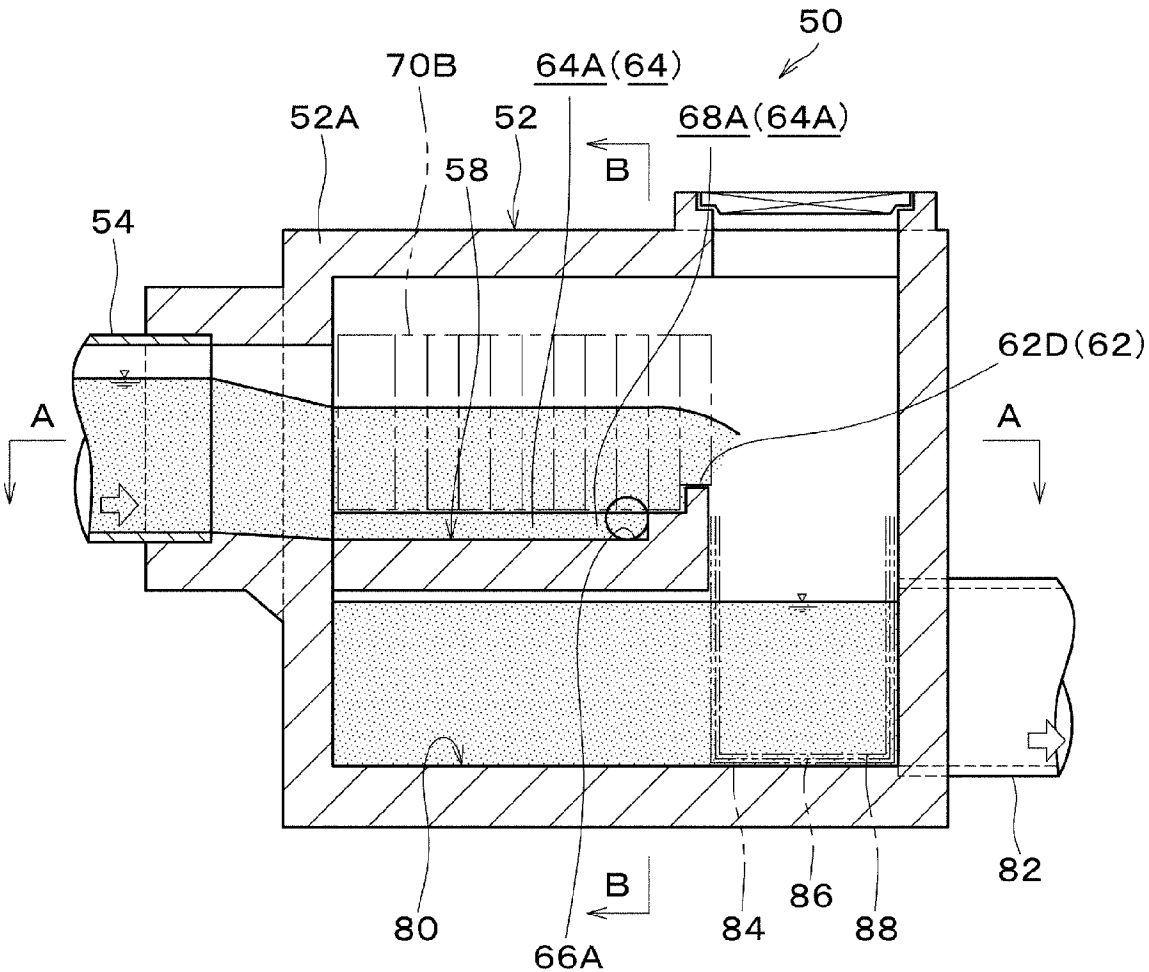
FIG. 17 is a cross-sectional view (sectional view taken along C-C in FIG. 15) of the flowing water splitting apparatus according to the second embodiment of the present invention.

A sewage pipe 236 (first pipe) connected to the first flowing water splitting apparatus 231 corresponds to the dirty pipe 16 (56) (see FIG. 2 or FIG. 16), the sewage pipe 232 corresponds to the confluent pipe 14 (54) (see FIG. 2 or FIG. 16), and the sewage pipe 234 corresponds to the rainwater pipe 18 (82) (see FIG. 2 or FIG. 16). Note that the flowing water splitting apparatus 10 or 50 shown in FIG. 1 or FIG. 15 is used for the first flowing water splitting apparatus 231.

To the first flowing water splitting apparatus 231, a second flowing water splitting apparatus 233 is connected via the sewage pipe 236. The sewage not flowing over the weir portions 24A to 24C (62A to 62C) (see FIG. 1 and FIG. 15) inside the first flowing water splitting apparatus 231 is led to the second flowing water splitting apparatus 233 via the sewage pipe 236. On the other hand, the sewage flowing over the weir portions 24A to 24C (62A to 62C) (see FIG. 1 and FIG. 15) inside the first flowing water splitting apparatus 231 is led to a river via the sewage pipe 234. Note that the flowing water splitting apparatus 10 or 50 shown in FIG. 1 or FIG. 15 is used for the second flowing water splitting apparatus 233.

To the second flowing water splitting apparatus 233, a sewage treatment apparatus 206 (flowing water treatment apparatus) is connected via a sewage pipe 238 (second pipe). Further, to the second flowing water splitting apparatus 233, a water storage apparatus 212 is connected via a sewage pipe 240 (third pipe). To the water storage apparatus 212, the sewage pipe 238 is connected via a sewage pipe 242 (fourth pipe) (note that the sewage pipe 242 can be configured not to be connected to the sewage pipe 238 but to be directly connected to the sewage treatment apparatus 206). Further, a sewage pipe 244 is connected to the sewage treatment apparatus 206 so that the purified sewage is drained to a river via the sewage pipe 244. As described above, the first flowing water splitting apparatus 231 and the second flowing water splitting apparatus 233 are connected in series.

The sewage pipe 238 connected to the second flowing water splitting apparatus 233 corresponds to the dirty pipe 16 (56) (see FIG. 2 or FIG. 16), and the sewage pipe 240 corresponds to the rainwater pipe 18 (82) (see FIG. 2 or FIG. 16).

According to the sewage system 230, the sewage supplied to the first flowing water splitting apparatus 231 through the sewage pipe 232 at the time of heavy rain is easy to flow over the weir portions 24A to 24C (62A to 62C) (see FIG. 1 and FIG. 15) because the splitting function for the sewage of the first flowing water splitting apparatus 231 is enhanced. Therefore, the water quantity of the sewage led from the first flowing water splitting apparatus 231 to the second flowing water splitting apparatus 233 is decreased. On the other hand, the water quantity of the sewage flowing from the first flowing water splitting apparatus 231 to a river through the sewage pipe 234 is increased.

The sewage flowing from the first flowing water splitting apparatus 231 to the second flowing water splitting apparatus 233 is further split inside the second flowing water splitting apparatus 233. Because the second flowing water splitting apparatus 233 has a high splitting function, the sewage led to the inside of the second flowing water splitting apparatus 233 is easy to flow over the weir portions 24A to 24C (62A to 62C) (see FIG. 1 and FIG. 15). Sewage not flowing over the weir portions 24A to 24C (62A to 62C) (see FIG. 1 and FIG. 15) of the sewage led to the inside of the second flowing water splitting apparatus 233 is led to the sewage treatment apparatus 206 through the sewage pipe 238. Sewage flowing over the weir portions 24A to 24C (62A to 62C) (see FIG. 1 and FIG. 15) of the sewage led to the inside of the second flowing water splitting apparatus 233 is led to the water storage apparatus 212 through the sewage pipe 240.

Here, because the sewage led to the inside of the second flowing water splitting apparatus 233 is easy to flow over the weir portions 24A to 24C (62A to 62C) (see FIG. 1 and FIG. 15), the water quantity of the sewage led to the sewage treatment apparatus 206 is decreased and the water quantity of the sewage led to the water storage apparatus 212 is relatively increased. The sewage led to the sewage treatment apparatus 206 is purified and then drained to a river. Further, the sewage led to the water storage apparatus 212 is temporarily stored in the water storage apparatus 212 and periodically led to the swage treatment apparatus 206.

As described above, according to the sewage system 230, the splitting function for the sewage of the first flowing water splitting apparatus 231 is improved, so that more sewage flows over the weir portions 24A to 24C (62A to 62C) (see FIG. 1 and FIG. 15) and to a river through the swage pipe 234. This significantly reduces the water quantity of the sewage led from the first flowing water splitting apparatus 231 to the second flowing water splitting apparatus 233. Further, the sewage led to the second flowing water splitting apparatus 233 is further split. Thus, the most of the sewage led to the second flowing water splitting apparatus 233 flows over the weir portions 24A to 24C (62A to 62C) (see FIG. 1 and FIG. 15) and is led to the water storage apparatus 212. Further, the sewage not flowing over the weir portions 24A to 24C (62A to 62C) (see FIG. 1 and FIG. 15) of the sewage led to the second flowing water splitting apparatus 233 is led to the sewage treatment apparatus 206. The sewage led to the water storage apparatus 212 is led to the sewage treatment apparatus 206 with a time lag.

Thus, the sewage is first split in the first flowing water splitting apparatus 231 so that a large quantity of the sewage flows over the weir portions 24A to 24C (62A to 62C) (see FIG. 1 and FIG. 15) to be led to a river. Further, a small quantity of the sewage not flowing over the weir portions 24A to 24C (62A to 62C) (see FIG. 1 and FIG. 15) in the first flowing water splitting apparatus 231 is led to the second flowing water splitting apparatus 232, so that the water quantity of the sewage led to the second flowing water splitting apparatus 233 can be greatly reduced. Then, the sewage led to the second flowing water splitting apparatus 233 is further split in the second flowing water splitting apparatus 233, and thereby the sewage flows over the weir portions 24A to 24C (62A to 62C) (see FIG. 1 and FIG. 15) to be led to the water storage apparatus 212. The sewage led to the water storage apparatus 212, however, is a small quantity because it is the part of the sewage split in the first flowing water splitting apparatus 231 and further split in the second flowing water splitting apparatus 233. Further, a small quantity of the sewage not flowing over the weir portions 24A to 24C (62A to 62C) (see FIG. 1 and FIG. 15) in the second flowing water splitting apparatus 233 is led to the sewage treatment apparatus 206, so that the water quantity of the sewage to be led to the sewage treatment apparatus 206 can be greatly reduced. In particular, the sewage led to the sewage treatment apparatus 206 is a very small quantity because it is the small quantity part of the sewage split in the first flowing water splitting apparatus 231 and further split in the second flowing water splitting apparatus 233. On the other hand, the sewage led to the water storage apparatus 212 is finally led to the sewage treatment apparatus 206, but is conveyed to the sewage treatment apparatus 206 after adjustment of time (with a time lag) in consideration of the purifying function of the sewage treatment apparatus 206. Therefore, it is possible to purify the sewage in accordance with the existing purifying function without increasing the size of the sewage treatment apparatus 206.

Summarizing the foregoing, the first flowing water splitting apparatus 231 and the second flowing water splitting apparatus 233 are connected in series, whereby the water quantity of the sewage led from the first flowing water splitting apparatus 231 to the second flowing water splitting apparatus 233 can be significantly reduced (a first sewage quantity reducing effect). Further, the water quantity of the sewage led from the second flowing water splitting apparatus 233 directly to the sewage treatment apparatus 206 can also be significantly reduced (a second sewage quantity reducing effect).

In addition, there also is sewage led from the second flowing water splitting apparatus 233 indirectly to the sewage treatment apparatus 206 via the water storage apparatus 212, in which the purifying function of the sewage treatment apparatus 206 is considered for the process of supplying the sewage from the water storage apparatus 212 to the sewage treatment apparatus 206. In other words, the sewage is conveyed from the water storage apparatus 212 to the sewage treatment apparatus 206 with a time lag while monitoring the remaining quantity of sewage that is being purified in the sewage treatment apparatus 206 (a third sewage quantity reducing effect). As described above, the first sewage quantity reducing effect, the second sewage quantity reducing effect, and the third sewage quantity reducing effect are simultaneously realized to make it unnecessary to increase the size of the sewage treatment apparatus 206 and to enhance the purifying function. As a result of this, the facility cost, the maintenance cost, and the running cost of the sewage treatment apparatus 206 can be significantly reduced.

Further, the water quantity of the sewage to be supplied to the sewage treatment apparatus 206 can be reduced, thus making it possible to completely purify the sewage in the sewage treatment apparatus 206 without improving the above-described purifying function. As a result of this, the completely purified sewage can be drained to a river to prevent contamination of the river.

In the above manner, the water quantity of the sewage flowing to the sewage treatment apparatus 206 is significantly reduced, so that the aforementioned problem 1 can be solved.

On the other hand, discussing the aforementioned problem 2, the sewage flowing over the weir portions 24A to 24C (62A to 62C) (see FIG. 1 and FIG. 15) inside the second flowing water splitting apparatus 233 flows into the water storage apparatus 212, but the water quantity of the sewage supplied from the first flowing water splitting apparatus 231 to the second flowing water splitting apparatus 233 is greatly reduced because of the high splitting function for the sewage of the first flowing water splitting apparatus 231 (the above-described first sewage quantity reducing effect). Therefore, the water quantity of the sewage flowing over the weir portions 24A to 24C (62A to 62C) (see FIG. 1 and FIG. 15) inside the second flowing water splitting apparatus 233 into the water storage apparatus 212 is significantly reduced because the sewage is the split sewage further split. As a result of this, it becomes unnecessary to increase the size of the water storage apparatus 212 to reduce the facility cost. Thus, the problem 2 can be solved.

What is claimed is:

1. A flowing water splitting apparatus for splitting water flowing from a confluent pipe and conveying the water to a dirty water pipe and a rainwater pipe, comprising:

a first opening portion to be connected to the confluent pipe;

a second opening portion to be connected to the dirty water pipe;

a third opening portion to be connected to the rainwater pipe, said third opening being situated at a location lower than that of the first opening portion or the second opening portion;

a first flowing water channel disposed between the first opening portion and the second opening portion for guiding the water from the confluent pipe to the dirty water pipe;

a second flowing water channel for guiding the water to the rainwater pipe;

a weir portion disposed adjacent to the first flowing water channel so that the water flows over the weir portion into the second flowing water channel when a quantity of the water exceeds a specific level;

a partition wall portion disposed in the first flowing water channel; and a flow throttle portion formed in the partition wall portion, wherein said partition wall portion includes a first partition wall portion so that the first flowing water channel is divided into a first water diversion chamber and a second water diversion chamber, and said weir portion includes a first weir portion disposed adjacent to the first water diversion chamber and a second weir portion disposed adjacent to the second water diversion chamber, said first weir portion having a height different from that of the second weir portion.

2. The flowing water splitting apparatus according to claim 1, wherein said partition wall portion includes a second partition wall portion so that the first flowing water channel is divided into the first water diversion chamber, the second water diversion chamber, and a third water diversion chamber.

3. The flowing water splitting apparatus according to claim 2, wherein said weir portion further includes a third weir portion disposed adjacent to the third water diversion chamber, said third weir portion having a height different from that of the first weir portion or the second weir portion.

4. The flowing water splitting apparatus according to claim 2, wherein said second weir portion is connected to the first partition wall portion and the second partition wall portion.

5. The flowing water splitting apparatus according to claim 2, wherein said second weir portion is arranged perpendicular to the first partition wall portion and the second partition wall portion.

6. The flowing water splitting apparatus according to claim 1, wherein said first flowing water channel is arranged to extend parallel to the second flowing water channel between the first opening portion and the second opening portion.

7. The flowing water splitting apparatus according to claim 1, wherein said first flowing water channel is arranged relative to the second flowing water channel so that the second flowing water channel is lower than the first flowing water channel.

8. The flowing water splitting apparatus according to claim 1, wherein said first flowing water channel is arranged relative to the second flowing water channel so that the second flowing water channel is at least partially overlapped with the first flowing water channel.

9. The flowing water splitting apparatus according to claim 1, wherein said flow throttle portion is an orifice formed in a lower portion of the partition wall portion.

10. The flowing water splitting apparatus according to claim 1, wherein said first weir portion is arranged in an inclined state relative to the first water diversion chamber so that the first water diversion chamber has a width decreasing toward the first partition wall portion, and said second weir portion is arranged parallel to the second water diversion chamber so that the second water diversion chamber has a relatively constant width.

11. The flowing water splitting apparatus according to claim 1, wherein said first weir portion is connected to the first partition wall portion.

* * * * *